US009174178B2

(12) United States Patent
Berger et al.

(10) Patent No.: US 9,174,178 B2
(45) Date of Patent: Nov. 3, 2015

(54) SEMI-CONTINUOUS FEED PRODUCTION OF LIQUID PERSONAL CARE COMPOSITIONS

(75) Inventors: Jason Andrew Berger, Cincinnati, OH (US); David Scott Dunlop, Mason, OH (US); Yunpeng Yang, Mason, OH (US); Douglas Allan Royce, Sunman, IN (US); Dawn Renee Knapek, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/156,840

(22) Filed: Jun. 9, 2011

(65) Prior Publication Data

US 2011/0305102 A1 Dec. 15, 2011

Related U.S. Application Data

(60) Provisional application No. 61/353,026, filed on Jun. 9, 2010.

(51) Int. Cl.

| | |
|---|---|
| ***B01F 15/00*** | (2006.01) |
| ***B01F 5/04*** | (2006.01) |
| ***B01F 5/06*** | (2006.01) |

(52) U.S. Cl.

CPC ..... *B01F 5/0405* (2013.01); *B01F 5/048* (2013.01); *B01F 5/0451* (2013.01); (Continued)

(58) Field of Classification Search

CPC ..... B01F 13/00; B01F 5/0405; B01F 5/04; B01F 5/0256; B01F 5/0451; B01F 5/0453; B01F 5/0456; B01F 5/0458; B01F 5/0473; B01F 5/0475; B01F 5/048

USPC ..... 366/137.1, 226, 338, 134, 76.9

See application file for complete search history.

(56) References Cited

U.S. PATENT DOCUMENTS 2,100,185 A * 11/1937 Engstrand ..... 417/170
3,298,669 A * 1/1967 Zingg ..... 366/178.1

(Continued)

FOREIGN PATENT DOCUMENTS

EP 0649867 A1 4/1995
EP 1945348 A1 7/2008

(Continued)

OTHER PUBLICATIONS

PCT International Search Report dated Sep. 2, 2011.

(Continued)

*Primary Examiner* — Tony G Soohoo
*Assistant Examiner* — Anshu Bhatia
(74) *Attorney, Agent, or Firm* — Linda M. Sivik

(57) ABSTRACT

A mixing assembly for use in a semi-continuous process for producing liquid personal care compositions, such as shampoos, includes a main feed tube carrying a base of the composition to be produced, a plurality of injection tubes in selective fluid communication with the main feed tube, and an orifice provided in a wall at an end of the main feed tube downstream of the plurality of injection tubes. The wall in which the orifice is provided includes a curved (e.g., semi-spherical) entry surface on an upstream or inlet side of an orifice, and a curved (e.g., semi-elliptical) exit surface on a downstream or outlet side of the orifice. The orifice may have a rectangular or elliptical shape. By maintaining symmetry of the injection tubes with respect to the orifice, and leveraging delay between introduction of dosed modules and increased viscosity, effective mixing may be achieved with minimal energy.

12 Claims, 26 Drawing Sheets

(52) U.S. Cl.
CPC ..... *B01F 5/0453* (2013.01); *B01F 5/0456* (2013.01); *B01F 5/0458* (2013.01); *B01F 5/0473* (2013.01); *B01F 5/0475* (2013.01); *B01F 5/0682* (2013.01); *B01F 5/0688* (2013.01); *B01F 2215/0431* (2013.01)

(56) References Cited

U.S. PATENT DOCUMENTS

| | | | | |
|---|---|---|---|---|
| 3,498,028 | A | 3/1970 | Trouw | |
| 3,917,756 | A * | 11/1975 | Rice | 366/177.1 |
| 4,034,773 | A * | 7/1977 | Huggins | 137/1 |
| 4,411,526 | A | 10/1983 | Chown et al. | |
| 4,416,610 | A * | 11/1983 | Gallagher, Jr. | 366/163.2 |
| 4,519,423 | A * | 5/1985 | Ho et al. | 366/178.1 |
| 4,786,185 | A | 11/1988 | Knief | |
| 4,915,300 | A | 4/1990 | Ryan | |
| 5,246,163 | A * | 9/1993 | Amano et al. | 366/10 |
| 5,290,482 | A | 3/1994 | Marschner et al. | |
| 5,440,011 | A | 8/1995 | Laine | |
| 5,466,395 | A | 11/1995 | Tosaka et al. | |
| 5,597,236 | A | 1/1997 | Fasano | |
| 5,876,705 | A | 3/1999 | Uchiyama et al. | |
| 6,293,294 | B1 * | 9/2001 | Loeb et al. | 366/163.2 |
| 6,603,320 | B2 | 8/2003 | Higo | |
| 6,765,024 | B1 | 7/2004 | Gray et al. | |
| 7,109,268 | B2 | 9/2006 | Creutz et al. | |
| 7,282,524 | B2 | 10/2007 | Gray et al. | |
| 7,351,749 | B2 | 4/2008 | Divone et al. | |
| 7,357,563 | B2 | 4/2008 | Phallen et al. | |
| 7,683,119 | B2 | 3/2010 | Creutz et al. | |
| 7,713,921 | B2 | 5/2010 | Boutique et al. | |
| 8,193,141 | B2 | 6/2012 | Corona, III et al. | |
| 8,240,908 | B2 | 8/2012 | Williams et al. | |
| 8,349,300 | B2 | 1/2013 | Wells et al. | |
| 2001/0003291 | A1 | 6/2001 | Uematsu et al. | |
| 2004/0030034 | A1 | 2/2004 | Chang et al. | |
| 2004/0116539 | A1 | 6/2004 | Biercevicz et al. | |
| 2004/0213751 | A1 | 10/2004 | Schwartz et al. | |
| 2005/0001062 | A1 | 1/2005 | McCracken et al. | |
| 2006/0109738 | A1 * | 5/2006 | Buchholz | 366/162.4 |
| 2006/0136150 | A1 | 6/2006 | Segelke et al. | |
| 2007/0009463 | A1 | 1/2007 | Niebauer et al. | |
| 2007/0044824 | A1 | 3/2007 | Capeci et al. | |
| 2007/0047383 | A1 | 3/2007 | Williams et al. | |
| 2007/0047384 | A1 | 3/2007 | McLaughlin et al. | |
| 2007/0258315 | A1 * | 11/2007 | Matula | 366/134 |
| 2008/0031084 | A1 | 2/2008 | Williams et al. | |
| 2008/0031085 | A1 | 2/2008 | McLaughlin et al. | |
| 2008/0139434 | A1 | 6/2008 | Basappa et al. | |
| 2008/0144425 | A1 * | 6/2008 | Etzenbach | 366/76.9 |
| 2008/0144427 | A1 | 6/2008 | Phallen | |
| 2008/0192566 | A1 * | 8/2008 | Yamashita et al. | 366/173.2 |
| 2008/0233061 | A1 | 9/2008 | Gates et al. | |
| 2009/0042765 | A1 | 2/2009 | Gizaw et al. | |
| 2009/0073801 | A1 | 3/2009 | Danner et al. | |
| 2010/0056647 | A1 | 3/2010 | Graham et al. | |
| 2011/0269661 | A1 | 11/2011 | Corona, III et al. | |
| 2011/0305102 | A1 | 12/2011 | Berger et al. | |
| 2011/0305648 | A1 | 12/2011 | Knapek et al. | |
| 2011/0305652 | A1 | 12/2011 | Hilvert et al. | |
| 2011/0305739 | A1 | 12/2011 | Royce et al. | |
| 2011/0305778 | A1 | 12/2011 | Caggioni et al. | |
| 2012/0164198 | A1 | 6/2012 | Johnson et al. | |

FOREIGN PATENT DOCUMENTS

| | | | |
|---|---|---|---|
| GB | 1446998 | | 8/1976 |
| JP | 62-169841 | A | 7/1987 |
| JP | 1176780 | A | 7/1989 |
| JP | 2006297173 | A | 11/2006 |
| JP | 2008-031115 | | 2/2008 |
| JP | 2009507289 | A | 2/2009 |
| JP | 2013514361 | A | 4/2013 |
| WO | 90 05583 | | 5/1990 |
| WO | 2007066660 | A1 | 6/2007 |
| WO | 2008/046519 | A1 | 4/2008 |

OTHER PUBLICATIONS

Personal Care Product Guide, Mild Surfactants. Maximum Performance, McIntyre Group, Ltd., Apr. 2007.

H.A. Barnes: J. Non-Newtonian Fluid Mech., vol. 70, 1997, pp. 1-33.

PCT International Search Report dated Oct. 10, 2011.

* cited by examiner

SEMI-CONTINUOUS FEED PRODUCTION OF LIQUID PERSONAL CARE COMPOSITIONS

CROSS REFERENCE TO RELATED APPLICATION

This application claims the benefit of U.S. Provisional Application No. 61/353,026, filed Jun. 9, 2010.

FIELD OF THE INVENTION

This disclosure relates generally to production of liquid personal care compositions, and more specifically, to an apparatus for facilitating continuous-stream production of such liquid personal care compositions.

BACKGROUND OF THE INVENTION

Liquid personal care compositions, such as shampoos, shower gels, liquid hand cleansers, liquid dental compositions, skin lotions and creams, hair colorants, facial cleansers, fluids intended for impregnation into or on wiping articles (e.g., baby wipes), laundry detergent, dish detergent, and other surfactant-based liquid compositions, are typically mass produced using batch processing operations. While viscosity of the compositions can be measured and adjusted in the large, fixed size, mixing tanks used in such batch processing systems, this approach does not provide optimal production requirements to meet the needs of facilities engaged in the production of numerous liquid compositions that share the same equipment to perform mixing operations.

Another drawback of conventional batch processing systems used in the production of liquid personal care compositions is the difficulty of cleaning the pipes and tanks to accommodate change-over to production of different personal care compositions. In order to reduce losses and avoid contamination of the next batch to be made, it is common to "pig" the feed lines or pipes leading to and/or from the batch tank and to wash out the batch tank. As this washout period can take up to 50% of the batch cycle time, a system that could significantly reduce changeover time would provide opportunities to increase production capacity and efficiency.

In addition to changeover time, significant quantities of unused components pigged through the lines during the changeover process are considered scrap and wasted when changeover occurs. Thus, a system that reduced such waste would be beneficial to the environment and would decrease cost of the finished product.

SUMMARY OF THE INVENTION

By employing a semi-continuous process instead of a batch process, a production facility can produce quantities that more accurately match consumer demand and output goals for a particular liquid personal care composition "run". Changeover time and waste can also be reduced. A semi-continuous process of the present disclosure for the production of liquid personal care compositions, such as shampoos, shower gels, liquid hand cleansers, liquid dental compositions, skin lotions and creams, hair colorants, facial cleansers, fluids intended for impregnation into or on wiping articles (e.g., baby wipes), laundry detergent, dish detergent, and other surfactant-based liquid compositions, employs a main feed tube carrying a base of various compositions to be produced, a plurality of injection tubes in selective fluid communication with the main feed tube, and at least one orifice provided at an end of the main feed tube downstream of the plurality of injection tubes. Each of the injection tubes may be disposed concentrically with respect to the other of the injection tubes, and may project through a side-wall of the main feed tube and either flush with an inner diameter of the main feed tube or into the main feed tube inwardly of an inner diameter of the main feed tube. As used herein, "disposed concenctrically with respect to the other of the injection tubes" refers to the injection tubes all intersecting the main feed tube at a common location along the axial length of the main feed tube, with the injection tubes disposed at angled increments from one another about the circumference of the main feed tube. In some embodiments of the present disclosure, while each of a first plurality of injection tubes is disposed concentrically with respect to the other of the first plurality of injection tubes, each of a second plurality of injection tubes may be disposed concentrically with respect to the other of the second plurality of injection tubes, but axially spaced from the axial position of intersection of the first plurality of injection tubes with the main feed tube. In some other embodiments, while the axial position of intersection of all injection tubes with a main feed tube may be the same, such that all of the injection tubes are disposed concentrically, the outlets of one or more of the injection tubes may be of different lengths from an inner diameter of the main feed tube than other of the injection tubes, such as one or more of the injection tubes terminating flush with the inner diameter, and other of the injection tubes terminating radially inwardly of the inner diameter of the main feed tube.

The combination of the injection tubes and the geometry of the orifice are used to dose the base of the composition and mix with the base a series of pre-manufactured isotropic liquid, liquid/liquid emulsion, or solid/slurry modules at a single point to generate a homogeneous mixture. In implementing a mixing assembly that can be used for a semi-continuous process in a large-scale production facility, there are several important design considerations. For instance, while it is desired to minimize energy requirements, it is recognized that if too little energy is used, the ingredients will not be adequately combined with one another to achieve a homogeneous mixture. On the other hand, if too much energy is used, this could destroy critical emulsion particle size distribution, adversely affecting desirable characteristics of the liquid personal care compositions being produced, such as the hair conditioning capability of shampoos.

In order to minimize waste during changeover to produce different personal care compositions, it is desired to dose the base carried in the main feed tube at a single point along the length of the main feed tube. As lines may need to be stopped periodically during production, the mixing assembly of the present disclosure has the ability to start and stop instantaneously without generating undesired scrap, thereby accommodating transient operation. The mixing assembly of the present disclosure is also fully drainable, and is resistant to microbial growth.

It is recognized that the design of the orifice blending system may vary depending on the nature of the particular liquid personal care composition to be blended. Different liquid personal care compositions vary widely in viscosities and can be assembled from ingredients, and in some cases, premixes, that cover a range of viscosities. Low viscosity liquid systems, particularly low viscosity systems made from at least predominantly low viscosity ingredients and/or low viscosity premixes, tend to require lower energy to blend than higher viscosity liquid systems. Lower viscosity liquid formulations may benefit from blending of at least some components upstream of the orifice, while higher viscosity liquid formulations may be detrimentally affected by such blending upstream of the orifice. One potential negative consequence of ineffectively-managed blending upstream of the orifice when attempting to mix a high viscosity liquid is inconsistent concentrations of fluid streams due to incomplete blending. For example, partial blending upstream of the orifice may induce fluctuations in concentration that remain, or even intensify, at the orifice. In this situation, these concentration gradients would exist downstream of the orifice, potentially resulting in unacceptable product concentration fluctuations, particularly when blending high viscosity liquids. In lower scale assemblies of the present disclosure, flow upstream of the orifice may be laminar and flow downstream of the orifice will be non-laminar. However, in higher-scale assemblies, flow even upstream of the orifice is likely to be non-laminar (i.e., the flow upstream of the orifice in higher-scale assemblies is likely to be turbulent, or at least transitional). Various design strategies are described herein that present trade-offs to understand when considering adjustments to make in order to achieve an acceptable balance for achieving the desired quality of mixing.

Thus, in systems that build viscosity, it is generally desired for blending to occur downstream of the orifice. This helps to optimize the level of energy used to achieve homogeneity. In addition to keeping down energy costs, use of lower energy levels reduces the risk of detrimental energy sensitive transformations, such as droplet breakup and/or particle size reduction. Described herein are various alternative approaches to the provision of multiple injection tubes in a semi-continuous liquid personal care composition blending system, as well as design considerations for the multi-injection tube blending system that may be factored in depending on the viscosity of the desired liquid composition.

The manner in which these and other benefits of the mixing assembly of the present disclosure is achieved is best understood with respect to the accompanying drawing figures and the following detailed description.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

Figure 6:
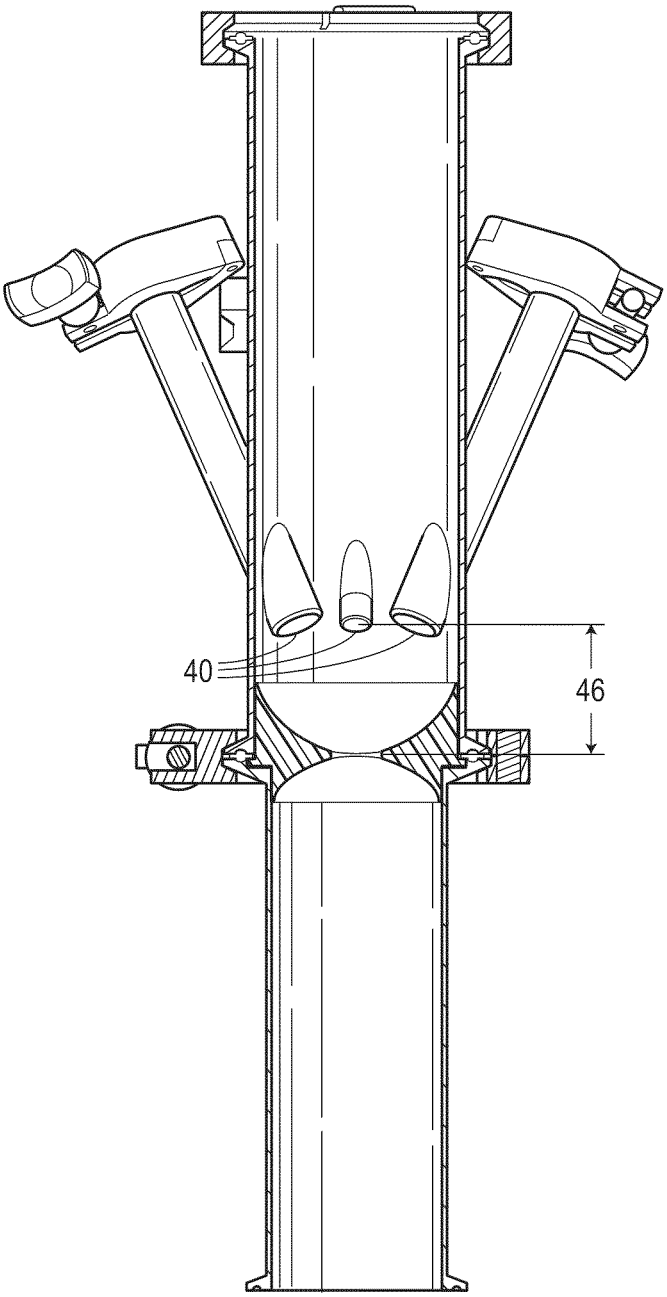
FIG. 6 is a cross-sectional view of the mixing assembly, taken along lines 6-6 of FIG. 5.
Figure 7:
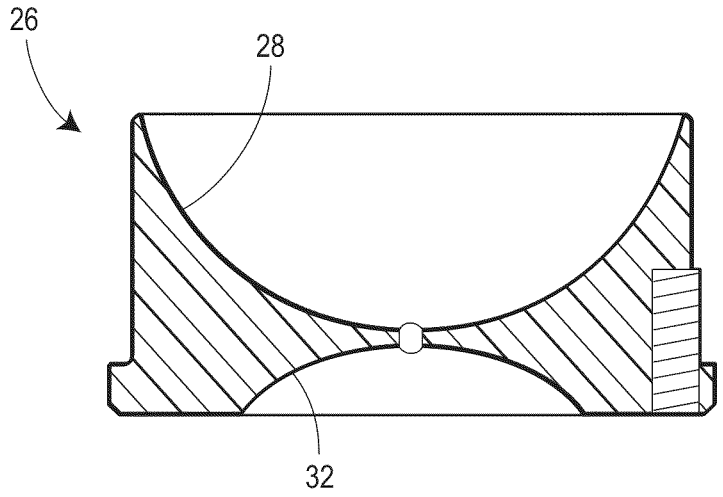
FIG. 7 is a cross-sectional view of the orifice insert of FIG. 2, taken along lines 7-7 of FIG. 2.
Figure 8:
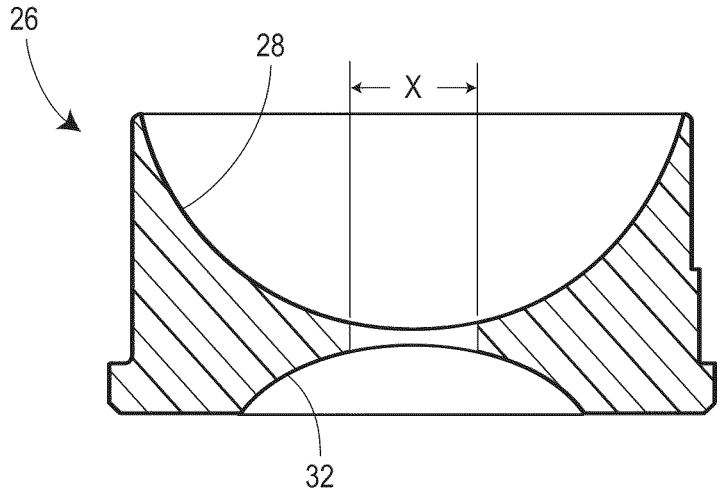
FIG. 8 is a cross-sectional view of the orifice insert of FIG. 2, taken along lines 8-8 of FIG. 2.

Referring to FIGS. 1, 4, 5 and 6, a mixing assembly 10 for use in a semi-continuous process for producing liquid personal care compositions, such as shampoos, shower gels, liquid hand cleansers, liquid dental compositions, skin lotions and creams, hair colorants, facial cleansers, fluids intended for impregnation into or on wiping articles (e.g., baby wipes), laundry detergent, dish detergent, and other surfactant-based liquid compositions, includes a main feed tube 12 carrying a base of the composition to be produced, a plurality of injection tubes 14, 16, 18, 20, 22, 24 in selective fluid communication with the main feed tube 12, and an orifice insert 26 provided at an end of the main feed tube 12 downstream of the plurality of injection tubes 14-24. By way of example only, the main feed tube 12 may have an inner diameter of 2.87 inch and an outer diameter of 3 inch. As illustrated in FIGS. 7 and 8, the orifice insert 26 includes a curved, e.g., semispherical, entry surface 28 on an upstream or inlet side of an orifice 30, and a curved, e.g., semi-elliptical, exit surface 32 on a downstream or outlet side of the orifice 30.

Figure 3:
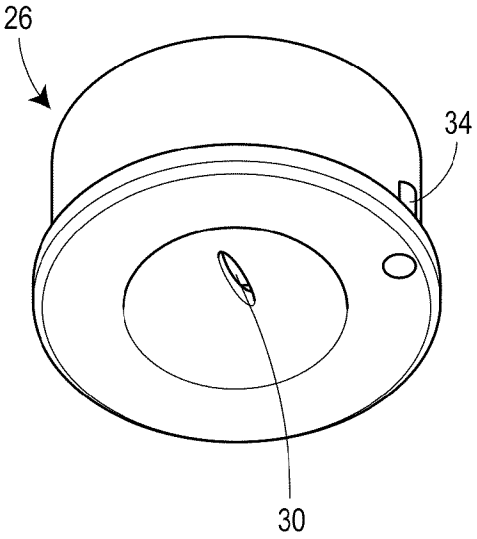
FIG. 3 is a perspective view of a downstream side of an alternate orifice insert for use in the mixing assembly of FIG. 1, wherein an orifice of the orifice insert is of an elliptical shape.
Figure 2:
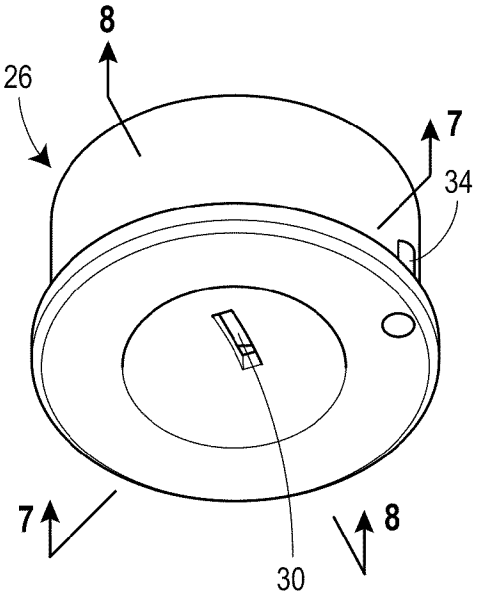
FIG. 2 is a perspective view of a downstream side of an orifice insert for use in the mixing assembly of FIG. 1, wherein an orifice of the orifice insert is of a rectangular shape.
Figure 1:
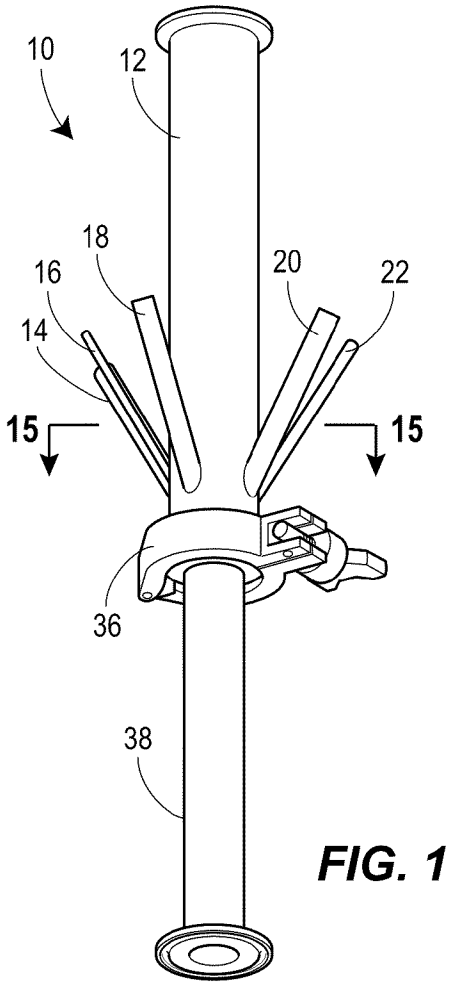
FIG. 1 is a front perspective view of a mixing assembly for use in a semi-continuous for the production of liquid personal care compositions.
Figure 4:
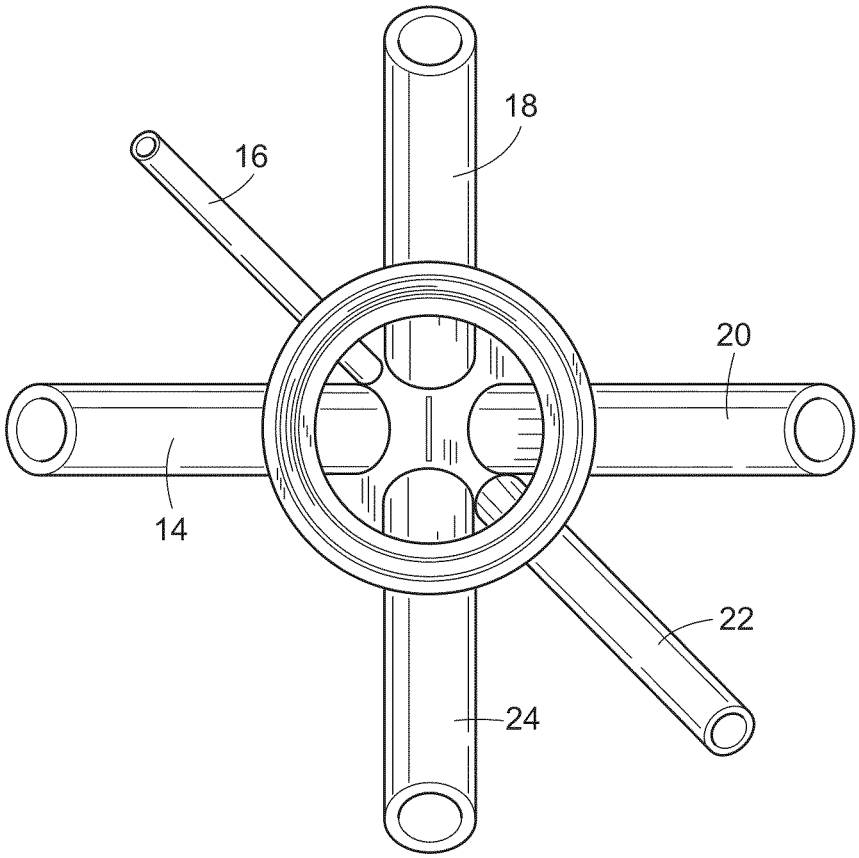
FIG. 4 is a upstream end view, facing downstream, of the mixing assembly of FIG. 1.
Figure 5:
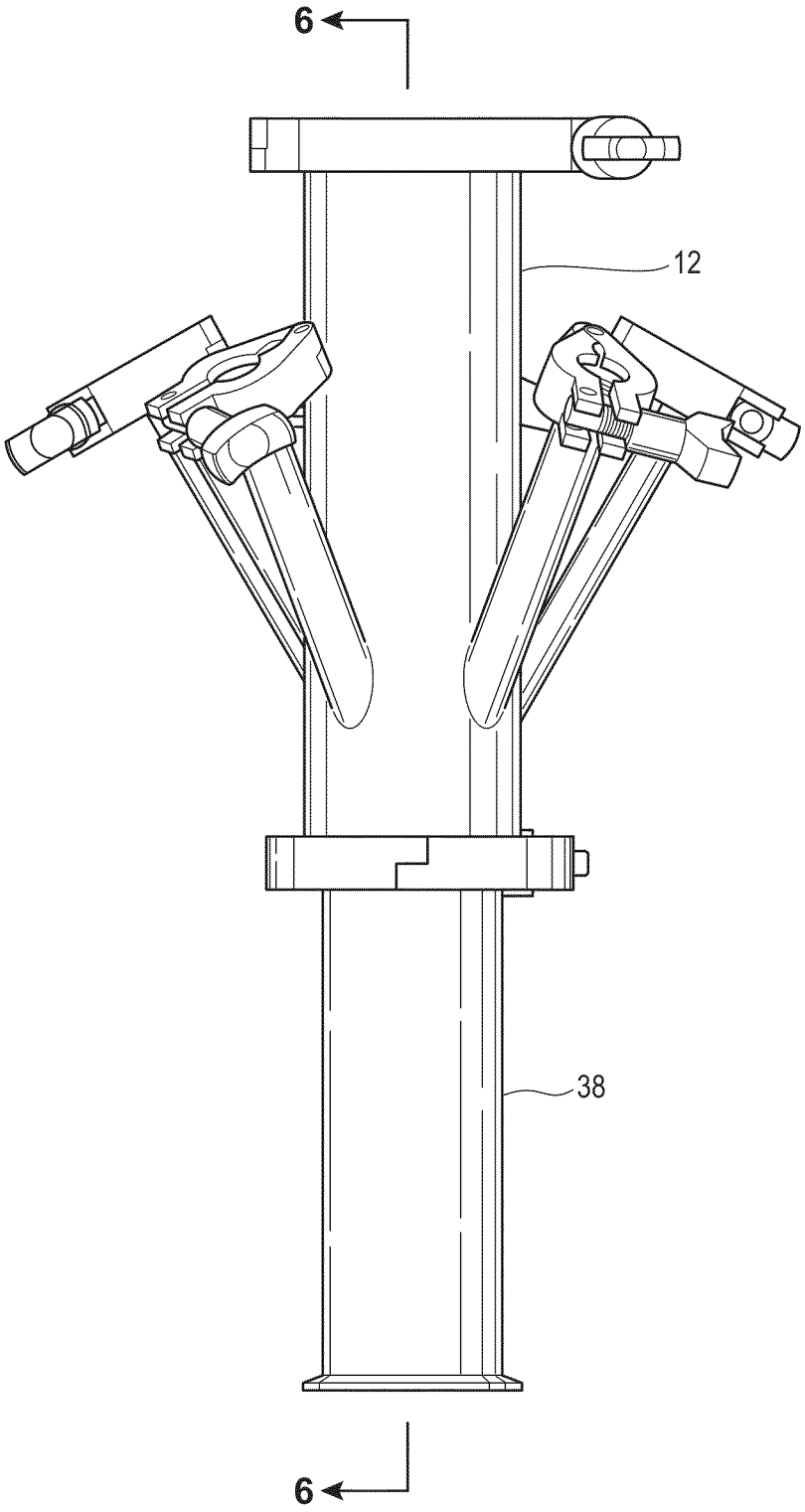
FIG. 5 is a front plan view of the mixing assembly of FIG. 1.

Providing the orifice 30 to mix the ingredients supplied by the injection tubes 14-24 into the base of the composition to be produced permits homogenous mixing at relatively low energy, as compared to batch mixing processes, for example. Low energy mixing is possible by virtue of a discernable lag or delay for viscosity growth to occur, estimated to be on the order of 0.25 seconds, after initial dosing of cosurfactants, salt solution, and other viscosity-modifying ingredients into the base of the composition to be produced. By taking advantage of this delay, the orifice 30 can be provided to induce turbulence at a single point just downstream of the exit of the injection tubes 14-24. While the orifice 30 may take a variety of shapes, with the selection of size and shape having potentially drastic affects on mixing efficiency, it is found that in the production of shampoos, optimal mixing may be achieved using an orifice 30 of a rectangular shape, as illustrated in FIG. 2, or an elliptical shape, as illustrated in FIG. 3. The rectangular or elliptical shape of the orifice 30 advantageously facilitates obtaining and maintaining a desired shear profile and velocity profile in a turbulent zone downstream of the orifice 30.

An additional design consideration in maintaining consistent shear profile across the orifice 30 is to maintain a limited distance between two of the edges of the orifice 30, such that the shear profile is kept tight. Large differences in shear rate across the orifice 30, if the energy level is not increased, would likely result in an undesirable, non-homogeneous mixture. A rectangular orifice 30 such as in FIG. 2 may be formed by stamping the orifice insert 26, whereas an elliptical-shaped orifice 30 such as in FIG. 3 must be imparted to the orifice insert 26 using greater precision, such as laser cutting. The orifice 30 preferably has an aspect ratio (length-to-depth) between 2 and 7, and when formed in a rectangular shape, a channel width or thickness of 1 mm-3 mm. By way of example only, a rectangular-shaped orifice 30 such as that illustrated in FIG. 2 may have a major axial length of 0.315 inch and a minor axial length of 0.078 inch. Also by way of example only, an elliptical-shaped orifice 30 such as that illustrated in FIG. 3 may have a major axis length of 0.312 inch, a minor axis length of 0.061 inch.

Figure 11:
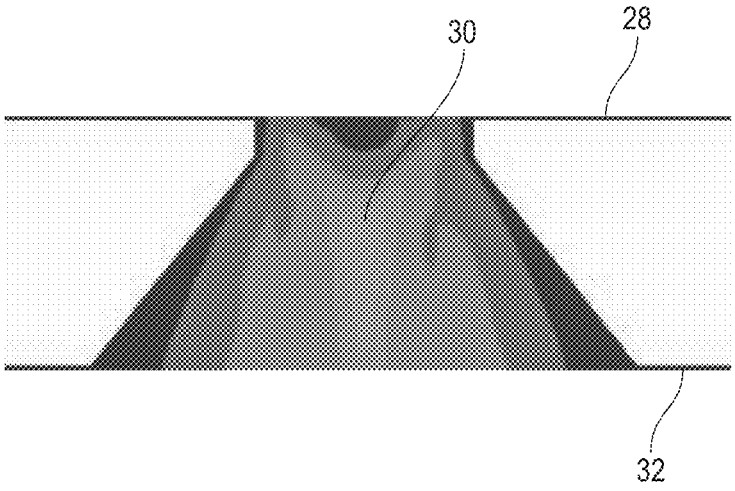
FIG. 11 illustrates a flow model of an orifice having a sharp-edged profile from an inlet side of the orifice to an outlet side of the orifice.
Figure 12:
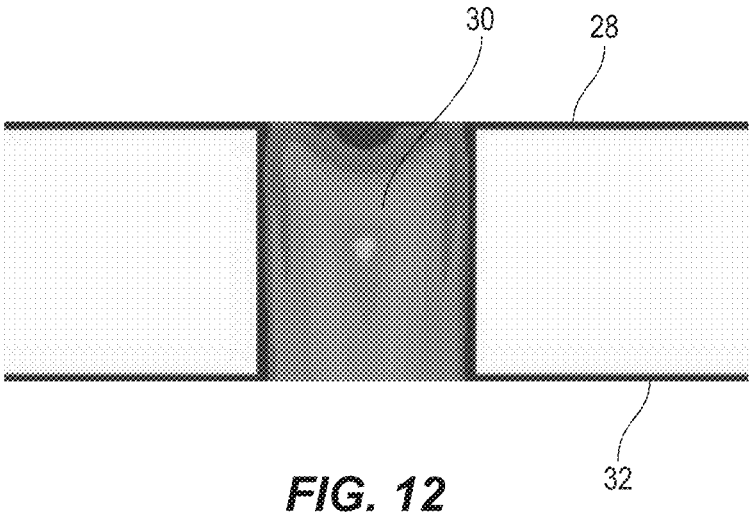
FIG. 12 illustrates a flow model of an orifice having a channel-shape.
Figure 13:
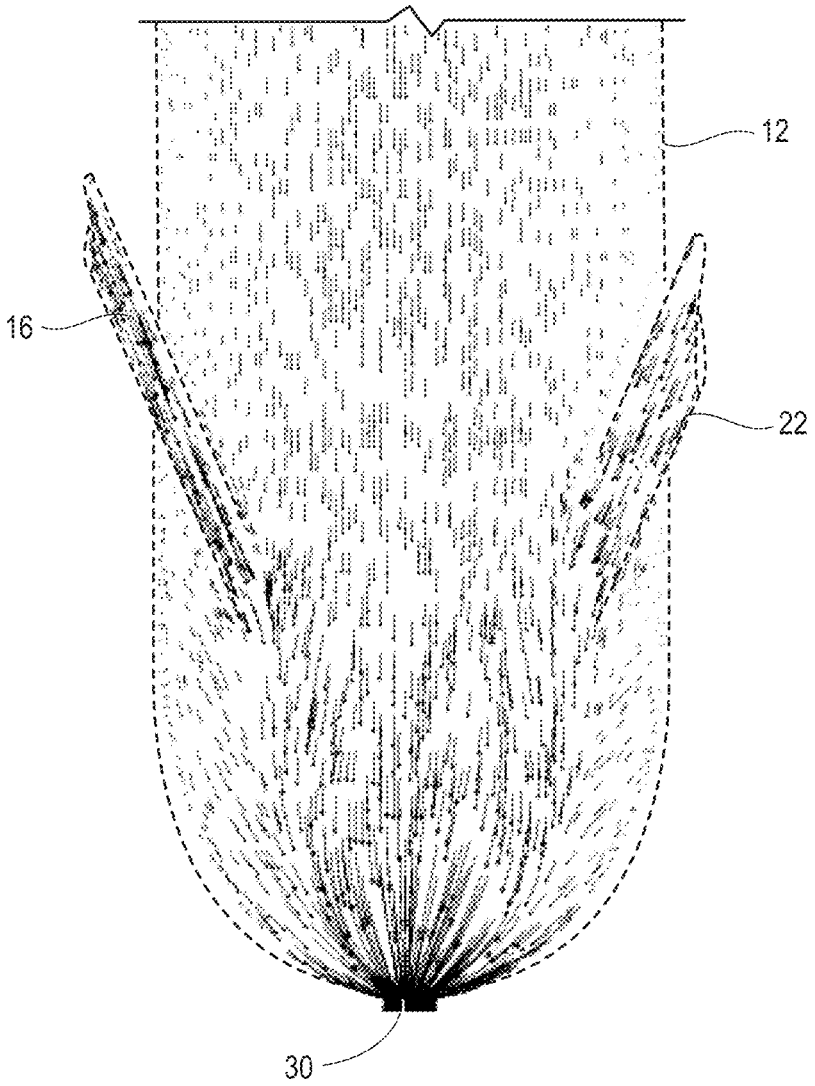
FIG. 13 is a cross-sectional view of a portion of the mixing tube assembly of FIG. 1 including a region of the main feed tube immediately upstream of the orifice insert of FIG. 2, illustrating the influence of bulk velocity of material fed through the main feed tube on mass flow injected into the main feed tube by two relatively large injection tubes of the mixing tube assembly.
Figure 14:
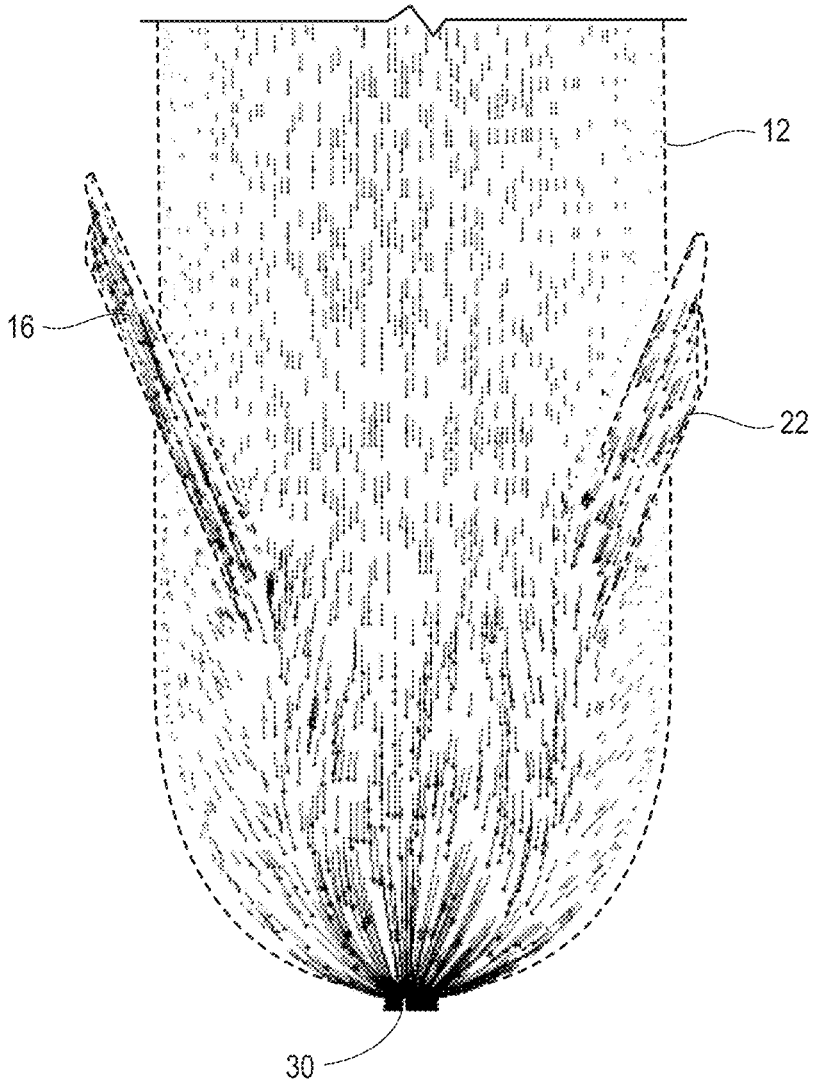
FIG. 14 is a cross-sectional view of a portion of the mixing tube assembly similar to FIG. 13, illustrating the relatively greater influence of bulk velocity of material fed through the main feed tube on mass flow injected into the main feed tube toward the orifice by two relatively smaller injection tubes of the mixing tube assembly.
Figure 15:
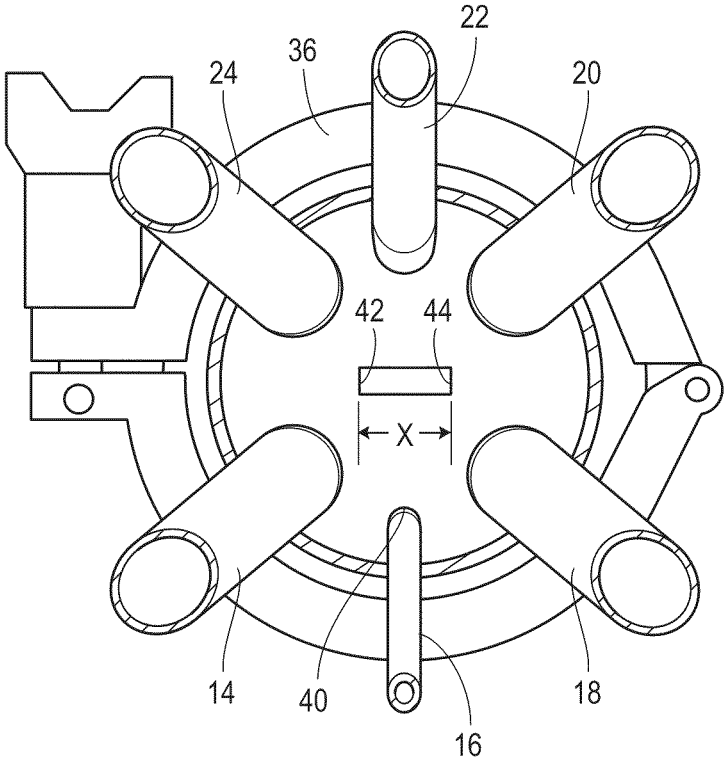
FIG. 15 is a top cross-sectional view of the mixing assembly, taken along lines 15-15 of FIG. 1.

While the orifice 30 may vary in thickness from an upstream side of the orifice 30 to a downstream side of the orifice 30, such as having a sharp edge as illustrated in FIG. 11, versus a straight channel (i.e., with a uniform thickness from the upstream side to the downstream side of the orifice 30), as illustrated in FIG. 12. It is found through the use of flow modeling via fluid dynamic prediction software that a higher turbulence profile may be achieved using the straight channel of FIG. 12 at energy levels similar to those required when using an orifice with a sharp edge, such as in FIG. 11, so there is a preference to utilize a straight channel. As it is desired to achieve optimal mixing while avoiding having to inject the ingredients into the main feed tube at excessive pressure, as is discussed further below the geometry of not only the orifice, but also of the relationship between the injection tubes to the orifice, are considered.

In the production of shampoos and other liquid personal care compositions, a number of liquid ingredients are added to a vanilla base and mixed. The vanilla base is a main surfactant mixture having a significantly lower viscosity than the final shampoo product. By way of example only, the vanilla base may include a mixture of Sodium Lauyl Sulfate (SLS), Sodium Laureth Sulfate (SLE1-10S/SLE35), and water. The ingredients added to the vanilla base include thickening agents such as sodium chloride (NaCl) solution and cosurfactants. Perfume is also added, which also tends to increase viscosity, as well as other polymers and/or pre-mixes to achieve a desired mixture and viscosity. When a given mixture of ingredients is predicted to result in too high of a viscosity, hydrotopes may be added to decrease viscosity.

The ingredients introduced to the vanilla base in the mixing assembly employed by the semi-continuous process of the present disclosure are not necessarily added in equal parts. For instance, in mixing shampoos, perfumes are added in relatively small concentrations relative to other ingredients. Perfume can therefore be introduced into the main feed tube 12 through a relatively smaller-diameter injection tube 16 than cosurfactants or other ingredients that are introduced in relatively higher concentrations. Similarly, Silicone emulsions may be added in smaller concentrations relative to other components. As illustrated in FIGS. 11 and 12, it is found that the bulk velocity of material fed through the main feed tube 12, i.e. the vanilla base for a shampoo product, has a greater influence on mass flow injected into the main feed tube 12 by two smaller-diameter injection tubes 16, 20 of the mixing tube assembly, such as perfumes and other components having low mass flow streams, than on mass flow injected into the main feed tube 12 by larger-diameter injection tubes 14, 18, 22, 24. To compensate for this discrepancy, the smaller-diameter injection tubes 16, 20 are positioned perpendicularly with respect to a major axis x of the orifice 30, i.e. at the 12:00 and 6:00 positions. In other words, an exit 40 of at least one of the injection tubes 16, 20 having a smaller inner diameter than the other injection tubes is disposed approximately equidistant to a first end 42 and a second end 44 of a major axis x of the orifice 30. It is further noted that larger-diameter injection tubes (not illustrated) may be employed to accommodate components to be introduced to the vanilla base at a higher mass flow rate.

When designing mixing assemblies of the present disclosure that employ different diameter injection tubes, it is particularly desirable to align the discharge of the various injection tubes such that discharge occurs at the desired point along the flow path of the orifice chamber.

It is recognized that it may be desired to replace the orifice insert 26 from time to time. In order to assist a set-up technician in achieving the proper orientation of the round orifice insert 26, it is desirable to provide an alignment pin 34 on the orifice insert 26. The alignment pin 34 may interface with a complementary pin-receiving aperture in the main feed tube 12, or in a clamping mechanism 36 that serves to lock such a removable orifice insert 26 in place with respect to the main feed tube 12 and a mixture-carrying tube 38 on the downstream side of the orifice insert 26. While the orifice insert 26 illustrated and described herein may be a separate, removable part, the orifice 30 may alternately be provided in an integral end wall of the main feed tube 12, in an integral end wall of the mixture-carrying tube 38, or in a dividing wall of an integral unit that includes both a main feed tube 12 on an upstream side of the orifice 30 and a mixture-carrying tube 38 on a downstream side of the orifice 30. Alternately, the orifice insert 26 may be formed as a separate part, but ultimately welded, or otherwise affixed, into permanent, non-removable association with one or both of the main feed tube 12 and the mixture-carrying tube 38.

The mixture-carrying tube 38 has a smaller diameter than that of the main feed tube 12. By way of example only, the mixture-carrying tube 38 may have an inner diameter of 2.37 inch and an outer diameter of 2.5 inch.

Symmetry of the components entering the orifice facilitates achieving an effective homogeneous mixture. Aiming the injector tubes 14-24 such that the exit 40 of each injection tube 14-24 is directed toward the orifice 30 helps to achieve the desired symmetry. So long as the injection tubes 14-24 are arranged in a geometry that achieves dosing their contents into the base of the component to be mixed, and passing such dosed base through the orifice 30 within the discernable lag or delay for viscosity growth to occur, estimated to be on the order of 0.25 seconds, there can be variability with respect to the angle of incline of each of the injection tubes 14-24 and the spacing of the exit 40 of each of the injection tubes 14-24 from the orifice 30. If the injection tubes 14-24 are misaligned, or if the dosed base does not pass through the orifice 30 before an on-set of increased viscosity, higher levels of energy may be required to achieve the desired homogeneity in the mixture. Alternatively, additional mixing zones, such as providing an additional orifice (not shown) in series with the orifice 30 may be required. While an injector tube angle of about 30° for a plurality of injector tubes 14-24 all having outlets spaced at an equal axial distance from the orifice 30 is found to be optimal, it is recognized that the injector tube angle can vary anywhere from 0°, such as if an elbow (not shown) is used to dose components into the base of the composition to be mixed in a direction along the axis of the main feed tube 12, to 90°, where the injection tubes enter in a direction perpendicular to the main feed tube 12.

The semispherical entry surface 28 on the upstream side of the orifice 30 helps to maintain the trajectory of the various components toward and into the orifice 30, thereby maintaining a predictable velocity profile of the material, avoiding stagnant zones or eddies, and helping control the projection of the components that might otherwise pre-mix the components to obtain a mixture. By way of example only, the semispherical entry surface 28 may be formed with a radius of 0.685 inch. The semi-elliptical exit surface 32 may be formed to have a curvature of an ellipse having a major axis length of 0.87 inch and a minor axis length of 0.435 inch. The elliptical or rectangular shape of the orifice 30 also helps maintain a shear profile and velocity profile that facilitates homogeneous mixing. Excessive shear due to, for example, excessive energy input, degrades the particle size of the emulsion, so it is optimal to keep the dimensions of the orifice 30 with an acceptable operating range, while also controlling upper and lower limits on shear or energy input, so as to strike the proper balance of homogeneity and emulsion particle size preservation. For energy conservation considerations, is also desirable to operate the semi-continuous process of the present disclosure at ambient temperature.

The exits 40 of each of the injection tubes 14-24 are in fluid communication with the base of the composition carried in the main feed tube 12. The exits 40 may be at the surface of the inner diameter of the main feed tube 12, but the injection tubes 14-24 preferably project through the side-wall of the main feed tube 12, such that the exits 40 are inwardly of the inner diameter of the main feed tube 12.

The mixture-carrying tube 38 may deliver the homogenous mixture of the liquid personal care composition directly to a bottling station. Alternatively, the mixture-carrying tube 38 may deliver all of the homogeneous mixture to a temporary holding tank (not shown), such as a 30-second surge tank, downstream of the orifice insert 26. A surge tank is desired in the event it is necessary to hydrostatically decouple the mixture prior to bottling, or to store small quantities of the mixture to monitor and prevent transient results from entering a run intended for distribution, i.e. for purposes of quality-control and reducing waste.

For bases used in the mixing of certain liquid personal care compositions, such as many shampoos, the base may be formed as a mixture of several non-viscosity-building soluble feeds, and it is necessary to re-agitate the base before dosing the other ingredients into the base via the injection tubes 14-24. For this purpose, a supply tank, such as a 90-second tank having one or more agitators therein, is provided upstream of the main feed tube 12.

Figure 16:
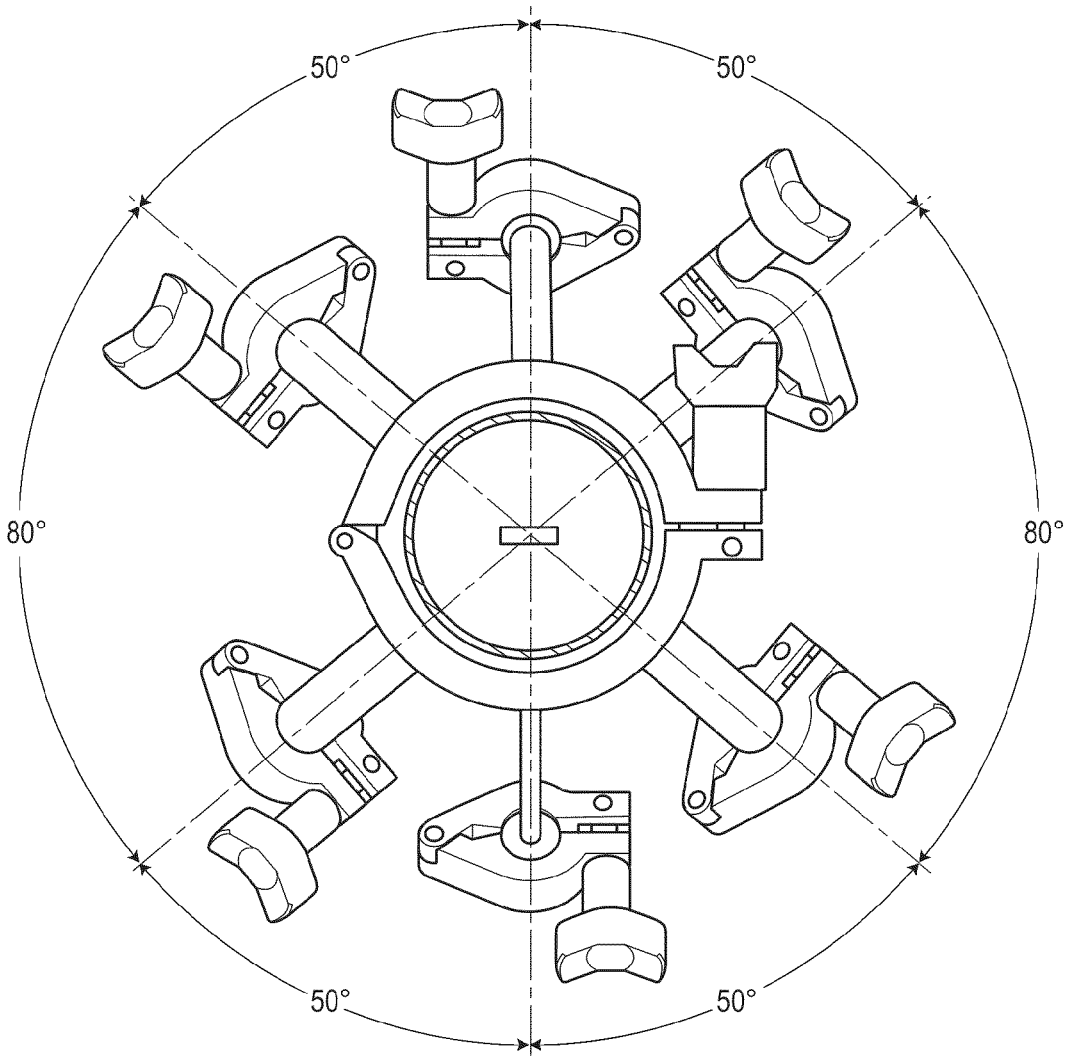
FIG. 16 is a bottom (taken from a downstream end) view of the mixing assembly of FIG. 5.

To facilitate change-over and cleaning of the mixing assembly, each of the injection tubes 14-24 is provided with a valve mechanism (not shown). Each of the injection tubes 14-24 may be further provided with a quick clamp tube fitting, such as a ½" sanitary fitting. The injection tubes 14-24 may be arranged in 50° to 80° increments from one another about the circumference of the main feed tube 12, as illustrated in FIG. 16. The injection tubes 14-24 may be made of stainless steel tubing or other metallurgy. By way of example only, four of the injection tubes 16, 18, 22, and 24 may have an inner diameter of 0.625 inch and an outer diameter of 0.75 inch. The perfume-carrying injection tube 14 may have an inner diameter of 0.152 inch and an outer diameter of 0.25 inch. At least one of the injection tubes 20 may be of an intermediate size, such as an inner diameter of 0.375 inch and an outer diameter of 0.5 inch. This intermediate size injection tube 20 may carry a Silicone emulsion, which, like perfume, may be added in a smaller concentration relative to other components dosed into the main feed tube 12. The remaining injection tubes 16, 18, 22 and 24 may carry one or more pre-manufactured isotropic liquid, liquid/liquid emulsion, or solid/liquid slurry modules that are necessary, useful, or desired for preparing a particular liquid personal care composition. As mentioned above, larger diameter injection tubes, i.e. injection tubes having a larger inner diameter than 0.625 inch, may be employed for accommodating components requiring or benefiting from a higher mass flow rate.

In the case of personal care compositions made up of many different ingredients, it is found necessary to pay particular attention to mixing assembly design variables controlling the manner in which the various ingredients are introduced so as to achieve optimal mixing downstream of the orifice and avoid undesired variations in concentrations of ingredients from bottle to bottle when the mixed product is packaged. For instance, a first plurality of injection tubes can introduce each of several ingredients into a main feed tube at a first axial distance relative to the orifice 30, while a second plurality of injection tubes can introduce each of several additional ingredients at a second axial distance relative to the orifice 30, the second axial distance being different from the first axial distance.

Ideally, all ingredients and premixes for mixing a given personal care composition would be added by a single plurality, or row, of injection tubes having outlets arranged in a single plane spaced at an equal axial distance relative to the orifice 30. However, it is recognized that some formulations require many components. In some cases, it is desirable to combine a subset of those components into one or more premixes and add them as a combined stream. However, sometimes this is not possible due to interactions among components, or may not be desirable due to such considerations as manufacturing costs, or control capability. Also, changes to washouts and scrap that can be generated as a combined stream that may be used for a subsequent production run may dictate whether it is more desirable to combine all components at once or premix a subset of components. Additionally, even if single plane alignment was optimal, geometric conflicts may prevent alignment of all injection tube outlets along a single plane.

Depending on the number of ingredients required for a given composition, assuming each ingredient requires a separate injection tube, at some point geometric size and space constraints prevent the positioning of all of the necessary injection tubes at the same region of the main feed tube, or at least prevent the injection tubes from all having their injector outlets disposed at the same axial distance from the orifice 30. Thus, two or more rows of injector outlets may be required.

The injector outlets of the first plurality of injection tubes, also referred to herein as a first row of injection tubes, collectively define an upstream boundary or upstream end of a first row injector region or zone, with the upstream side of the orifice 30 defining a downstream boundary or downstream end of the first row injector zone. The injector outlets of the second plurality of injection tubes, also referred to herein as a second row if injection tubes, collectively define an upstream boundary, or upstream end, of a second row injector zone, with the upstream boundary of the first row injector zone also defining the downstream boundary or downstream end of the second row injector zone. The region of the assembly downstream of the outlet of the orifice 30 is referred to herein as a downstream zone.

Turning now to FIGS. 17-34, various embodiments are described in which there are two rows of injection tubes. It will be understood that additional rows of injection tubes (beyond two) are also contemplated as within the scope of the present disclosure.

Figure 17:
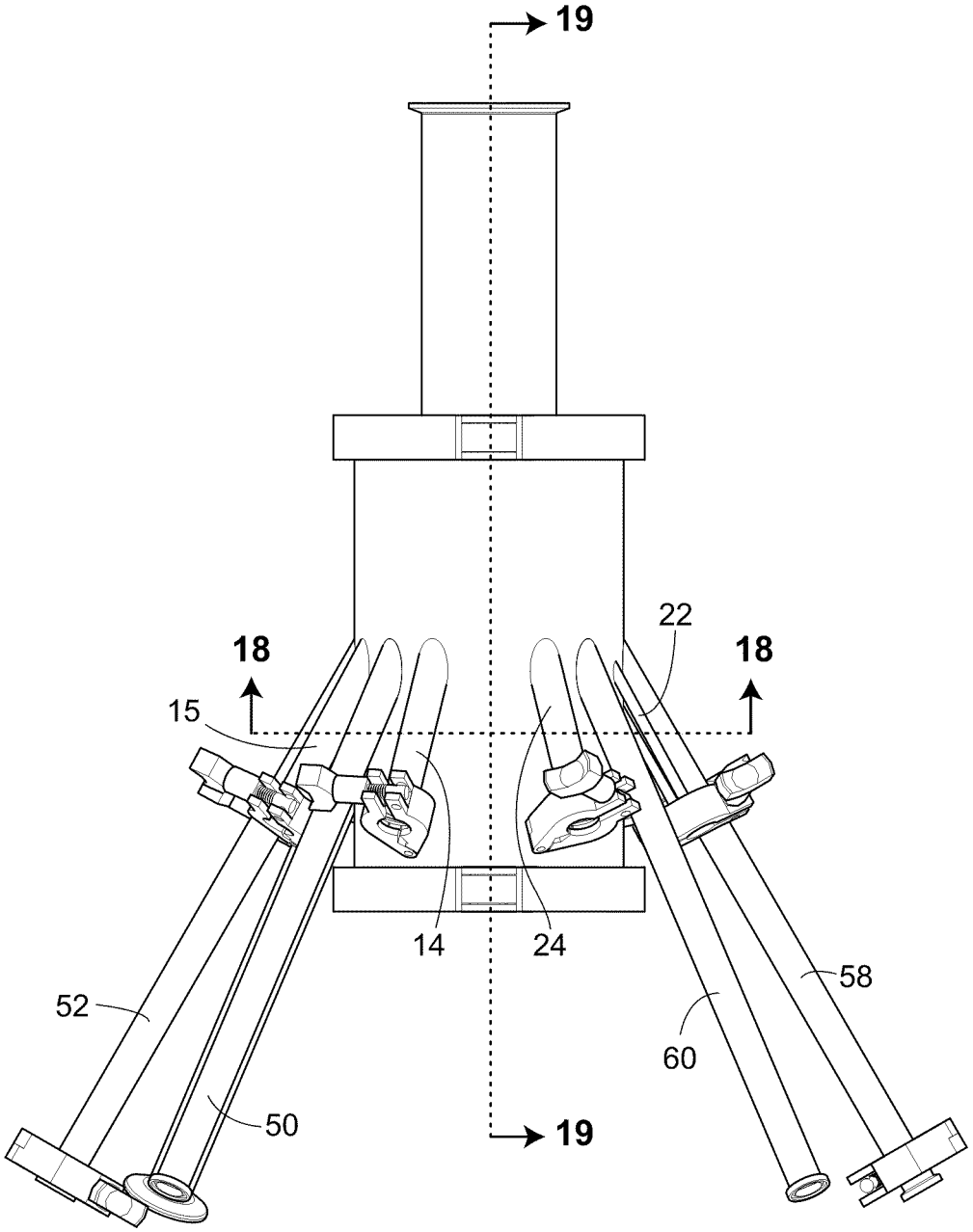
FIG. 17 is a front plan view of a mixing assembly for use in a semi-continuous for the production of liquid personal care compositions including a first plurality of injection tubes and a second plurality of injection tubes, all intersecting a main feed tube at a common axial distance from an orifice, with each of the first plurality of injection tubes terminating at a distance radially inwardly of an inner diameter of the main feed tube and each of the second plurality of injection tubes terminating at the inner diameter of the main feed tube.
Figure 18:
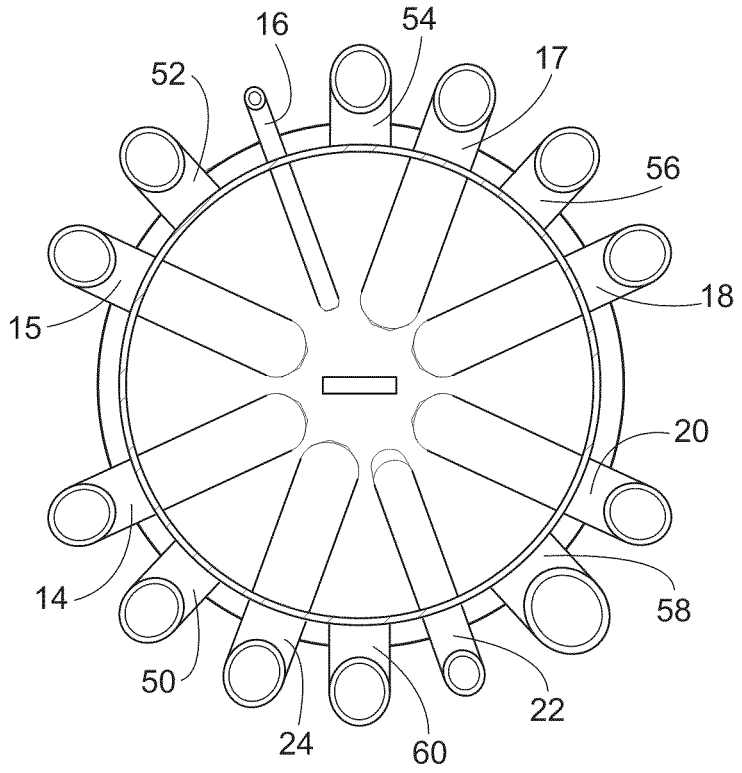
FIG. 18 is a cross-sectional view taken along lines 18-18 of FIG. 17.
Figure 19:
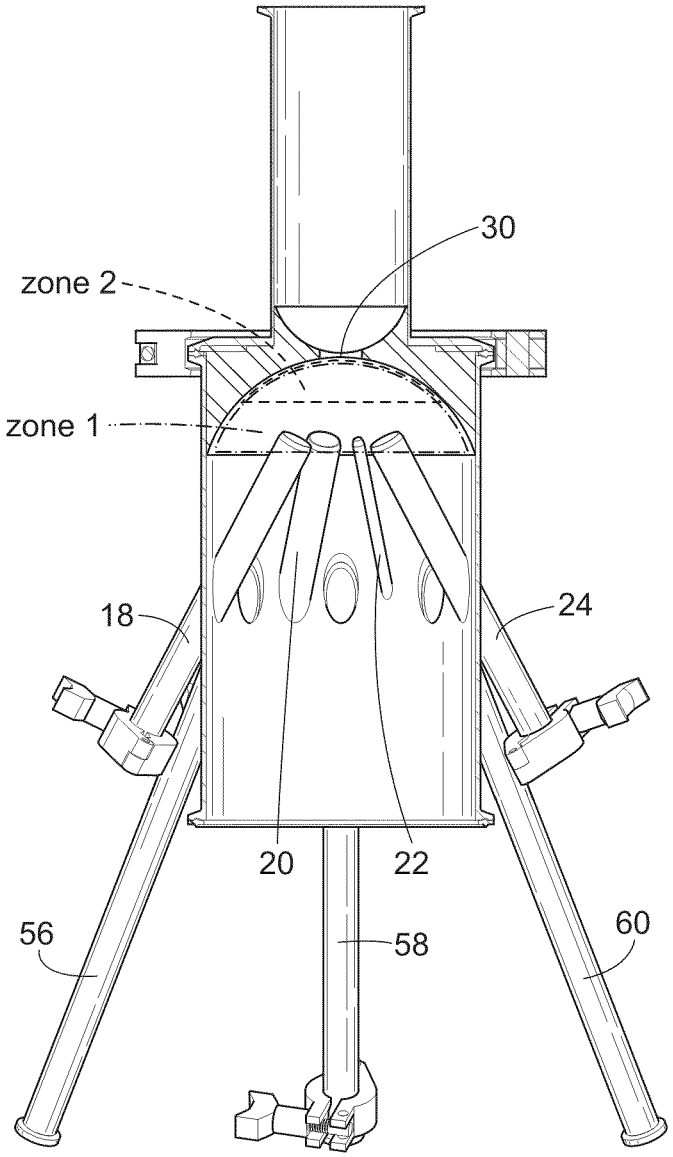
FIG. 19 is a cross-sectional view taken along lines 19-19 of FIG. 18.

According to the embodiment of FIGS. 17-19, a main feed tube 12 of a mixing assembly 10 carries a vanilla base. A first plurality of injection tubes 14, 15, 16, 17, 18, 20, 22, 24 is provided in a circular arrangement about the main feed tube 12, each of the first plurality of injection tubes 14-24 intersecting the main feed tube 12 and having an injector outlet projecting inwardly of an inner diameter of the main feed tube 12. All of the injector outlets of the first plurality of injection tubes 14-24 terminate an equal axial distance from the orifice 30. A first row injector zone (zone 1) within the main feed tube 12 (depicted by dot-dashed lines in FIG. 19) is bounded by a plane defined by upstream ends of the injector outlets of the first plurality of injection tubes 14-24 (which plane defines the upstream boundary of the first row injector zone), and an upstream end of the orifice 30, which defines a downstream boundary of the first row injector zone.

A second plurality of injection tubes 50, 52, 54, 56, 58, 60, is also provided in a circular arrangement about the main feed tube 12. In this embodiment, the second plurality of injection tubes 50-60 intersect the main feed tube 12 at the same axial location, i.e. the same axial distance from the orifice 30, as the first plurality of injection tubes 14-24. However, rather than having injector outlets that project inwardly of the inner diameter of the main feed tube 12, the second plurality of injection tubes 50-60 have injector outlets that coincide (i.e. are flush or substantially flush with) with the inner diameter of the main feed tube 12. A second row injector zone (zone 2) within the main feed tube 12 (depicted by dashed lines in FIG. 19) is bounded by a plane defined by where components from the injector outlets of the second plurality of injection tubes 50-60 first begin to encounter component streams from the injector outlets of the first plurality of injection tubes 14-24 (i.e., where streams of fluid components delivered by each of the second plurality of injection tubes 50-60 first encounter streams of fluid components delivered by each of the first plurality of injection tubes 14-24, which may be located by identifying a point upstream of the orifice 30 at which projection lines extended from a center of two or more of the injection tubes 50-60 intersect with projection lines extended from a center of two or more of the injection tubes 14-24), which plane defines the upstream boundary of the second row injector zone, and the downstream boundary of the first row injector zone (i.e., the upstream end of the orifice 30), which also defines a downstream boundary of the second row injector zone.

Figure 9:
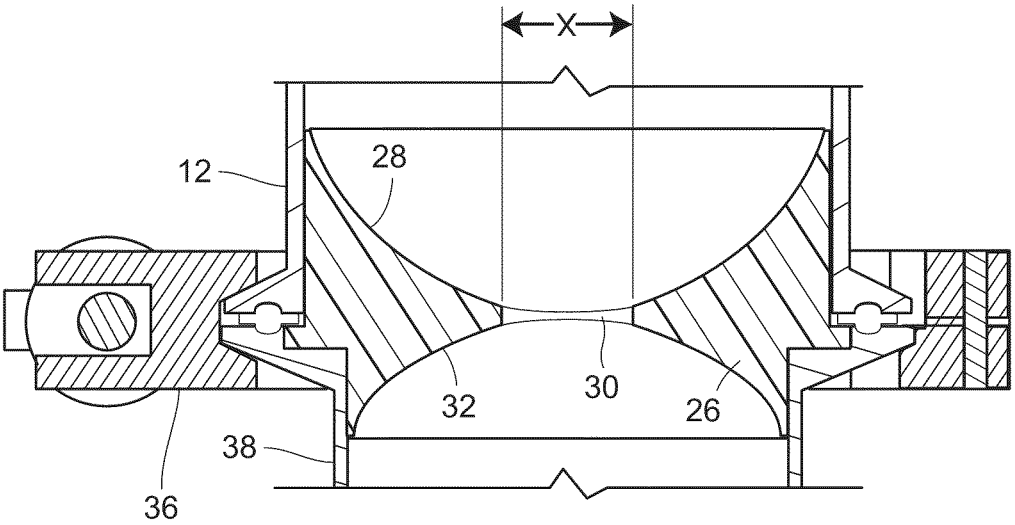
FIG. 9 is an enlarged cross-sectional view of the orifice insert of FIG. 2, as inserted and secured in position in the mixing assembly of FIG. 1.
Figure 10:
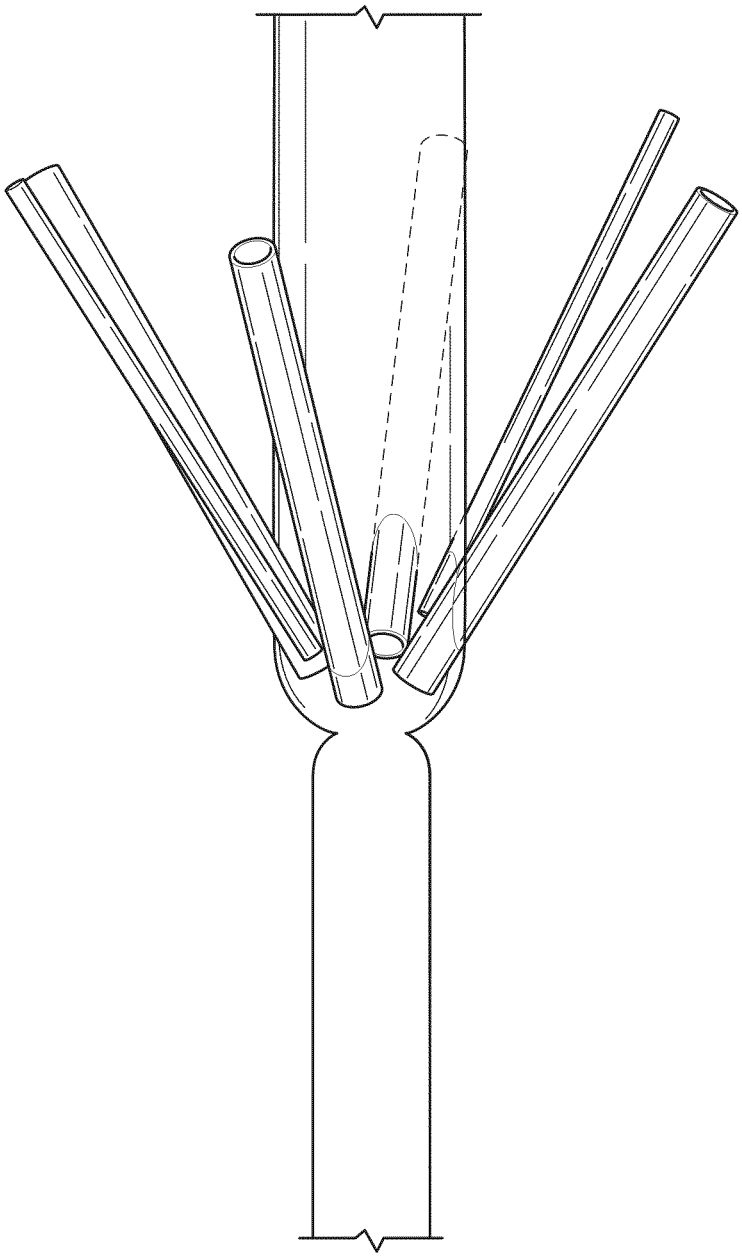
FIG. 10 is a perspective view of the mixing assembly of FIG. 1, with a main feed tube of the mixing assembly partially cut away.
Figure 20:
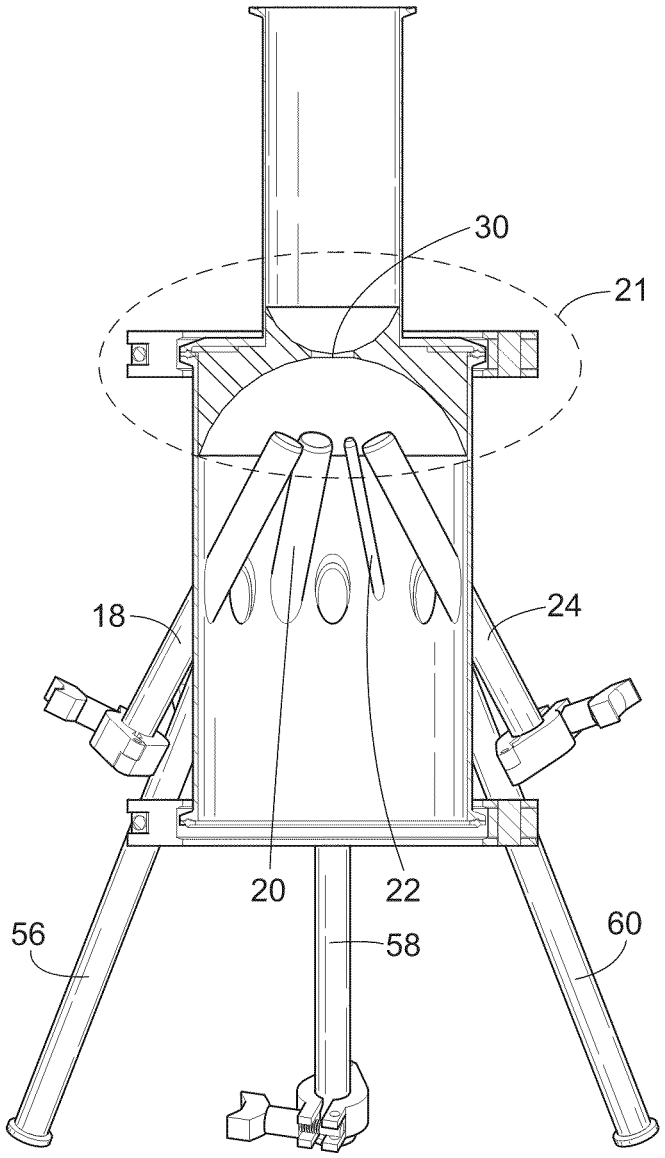
FIG. 20 is a cross-sectional view similar to FIG. 17, illustrating an accessible orifice zone and a clamp mechanism to facilitate access thereto.
Figure 21:
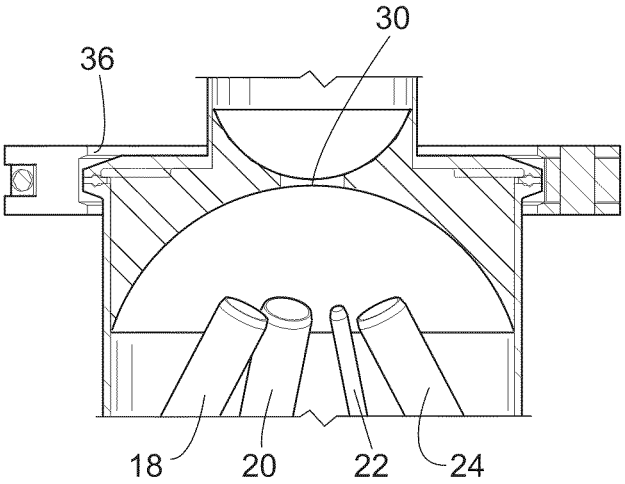
FIG. 21 is an enlarged cross-sectional region taken along line 21 of FIG. 20.
Figure 22:
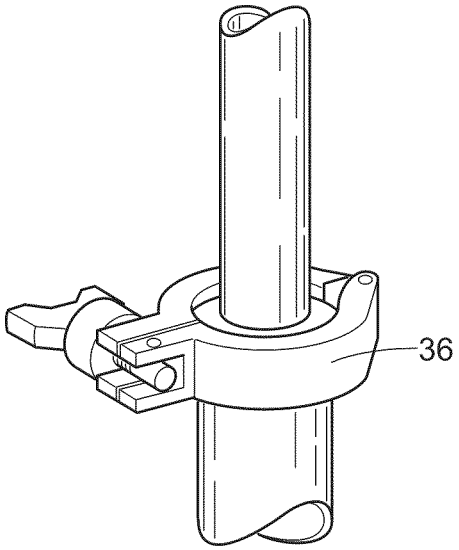
FIG. 22 is a perspective view of the clamp mechanism illustrated in FIGS. 20 and 21.

The embodiment illustrated in FIGS. 20-22 is similar to that illustrated in FIGS. 17-19, but includes a clamping mechanism 36 such as illustrated in FIG. 9 to provide access to the orifice 30 for maintenance or replacement.

Figure 23:
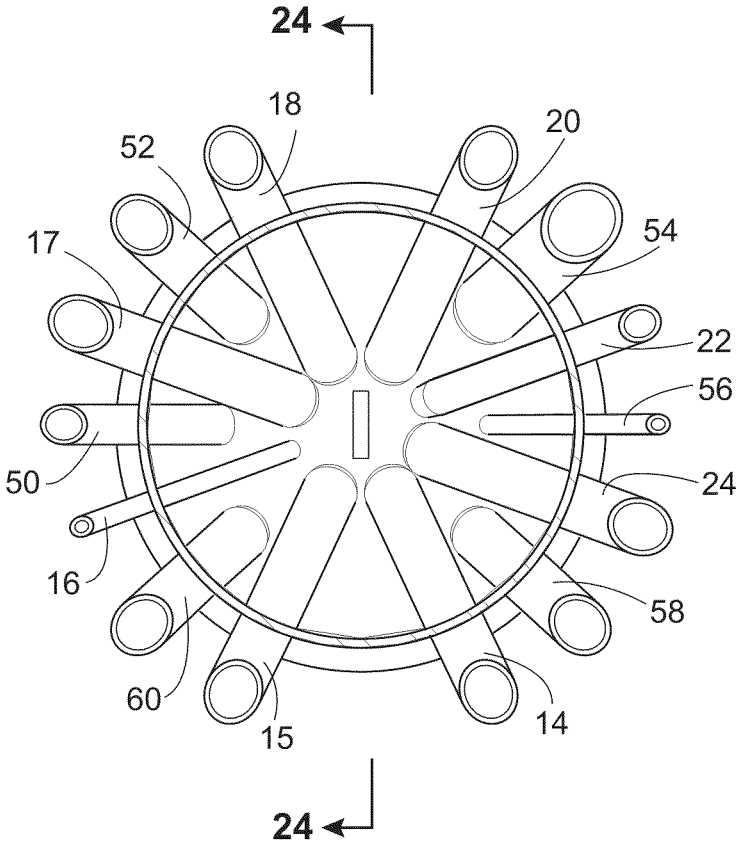
FIG. 23 is a cross-sectional view similar to FIG. 18, illustrating a mixing assembly for use in a semi-continuous for the production of liquid personal care compositions including a first plurality of injection tubes and a second plurality of injection tubes, all intersecting a main feed tube at a common axial distance from an orifice, with each of the first plurality of injection tubes terminating at a distance radially inwardly of an inner diameter of the main feed tube and each of the second plurality of injection tubes also terminating inwardly of the inner diameter of the main feed tube, but at a greater axial distance from the orifice than the first plurality of injection tubes.
Figure 24:
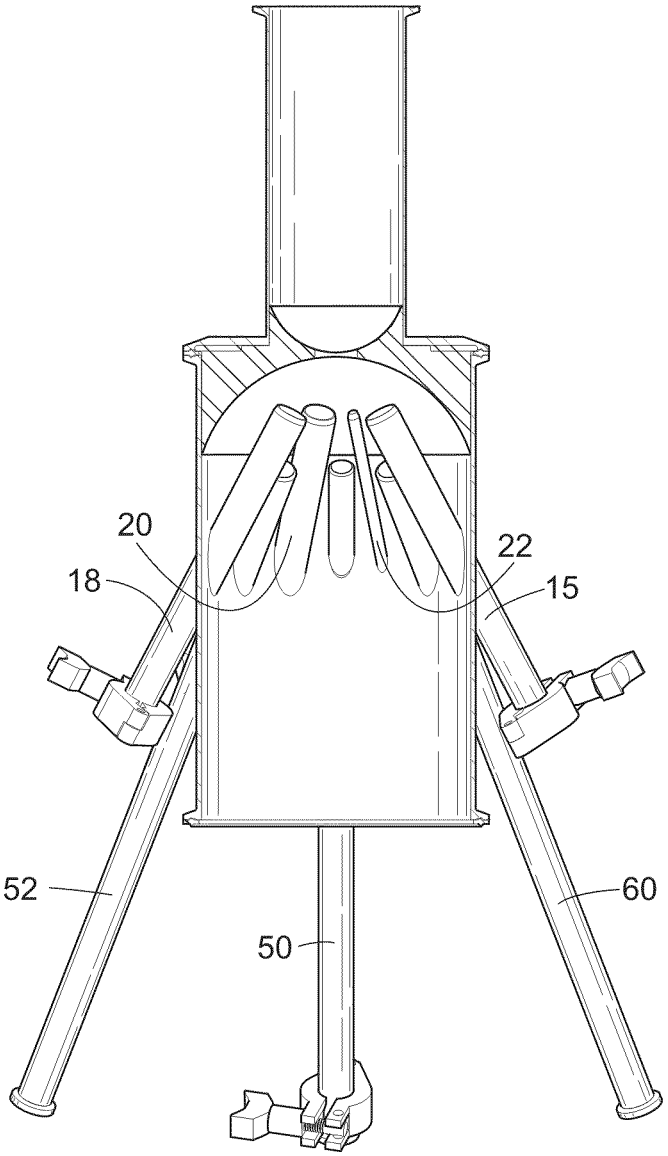
FIG. 24 is a cross-sectional view of the mixing assembly illustrated in FIG. 23, taken along lines 24-24 of FIG. 23.

In the embodiment illustrated in FIGS. 23 and 24, similar to the embodiment illustrated in FIGS. 17-19, the second plurality of injection tubes 50-60 intersect the main feed tube 12 at the same axial location as the first plurality of injection tubes 14-24. However, instead of coinciding with the inner diameter of the main feed tube 12, each of the second plurality of injection tubes 50-60 projects inwardly of the inner diameter of the main feed tube 12, and has an injector outlet spaced axially farther from the orifice 30 than the injector outlets of the first plurality of injection tubes 14-24.

Figure 25:
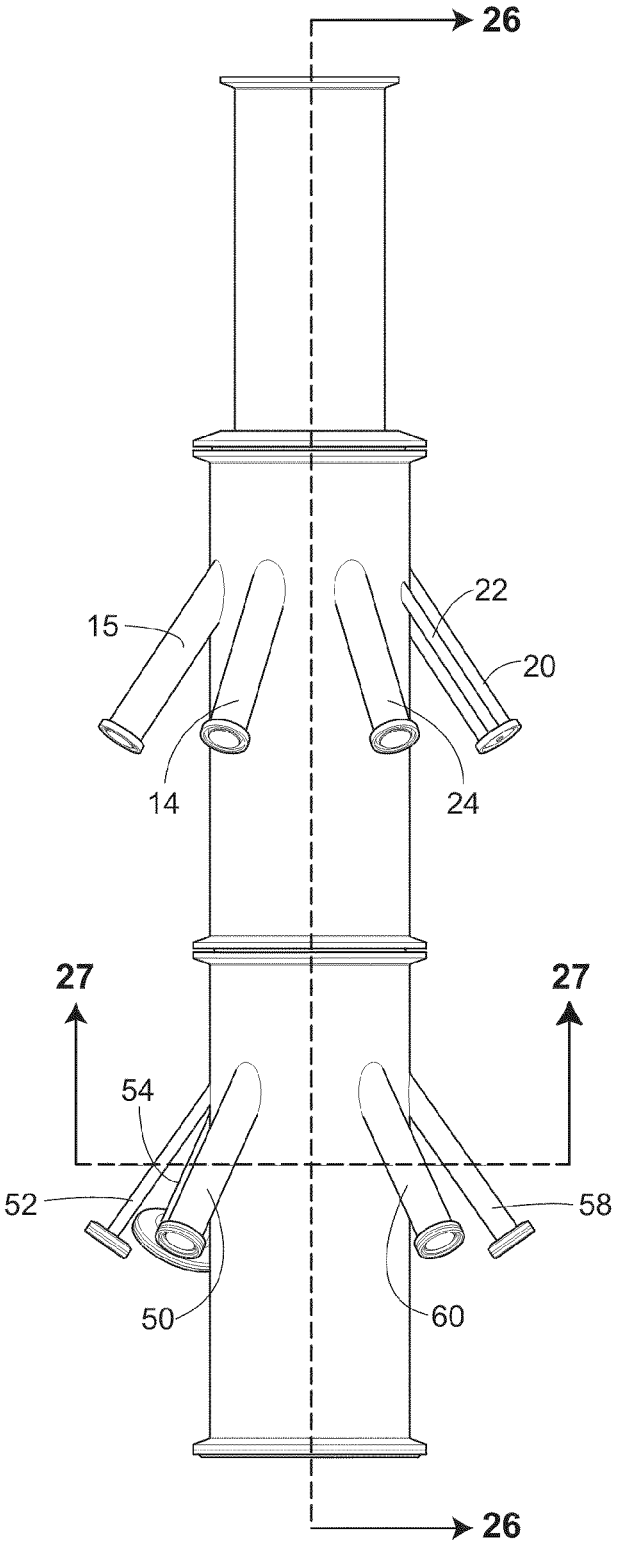
FIG. 25 is a front plan view of a mixing assembly for use in a semi-continuous for the production of liquid personal care compositions including a first plurality of injection tubes intersecting a main feed tube at a first axial distance from an orifice and a second plurality of injection tubes intersecting the main feed tube at a second axial distance from the orifice, the second axial distance being different from the first axial distance, and each of the second plurality of injection tubes intersecting the main feed tube and terminating at the same angle as each of the first plurality of injection tubes.
Figure 26:
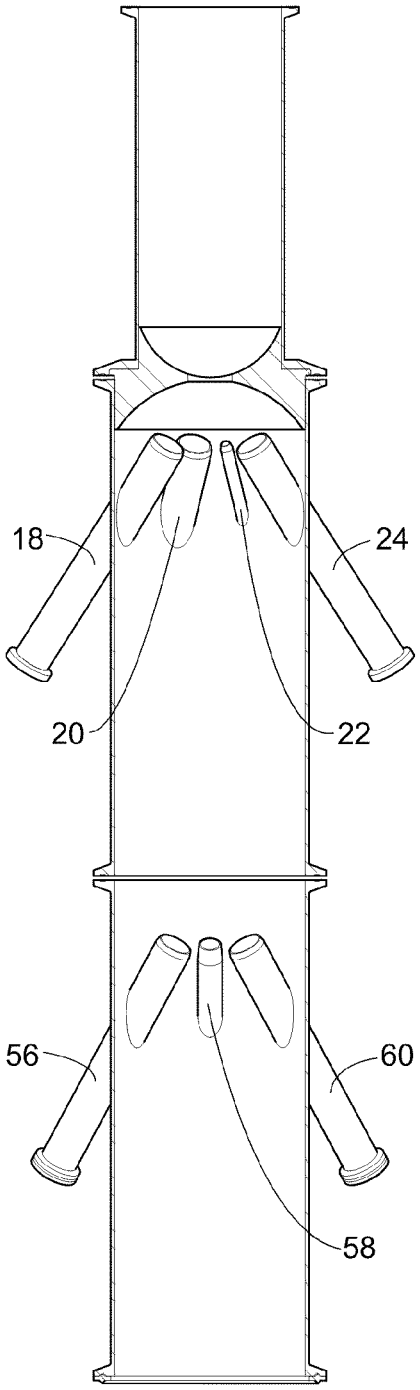
FIG. 26 is a cross-sectional view taken along lines 26-26 of FIG. 25.
Figure 27:
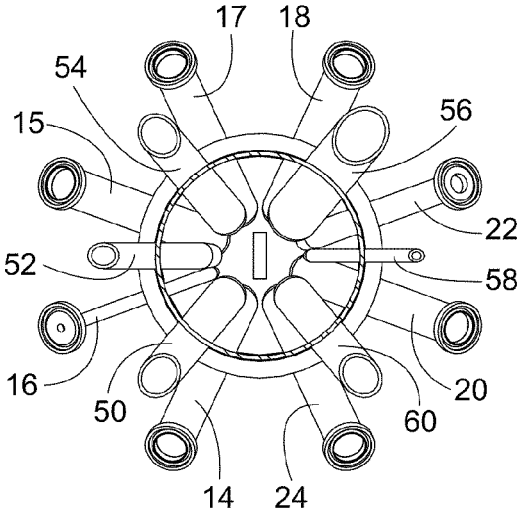
FIG. 27 is a cross-sectional view taken along lines 27-27 of FIG. 25.

In the embodiment illustrated in FIGS. 25-27, the second plurality of injection tubes 50-60 intersect the main feed tube 12 at a different axial location relative to the orifice 30 than the first plurality of injection tubes 14-24. In this embodiment, the second plurality of injection tubes 50-60 may form the same non-zero angle with respect to the axis of the main feed tube as the first plurality of injection tubes 14-24.

Figure 28:
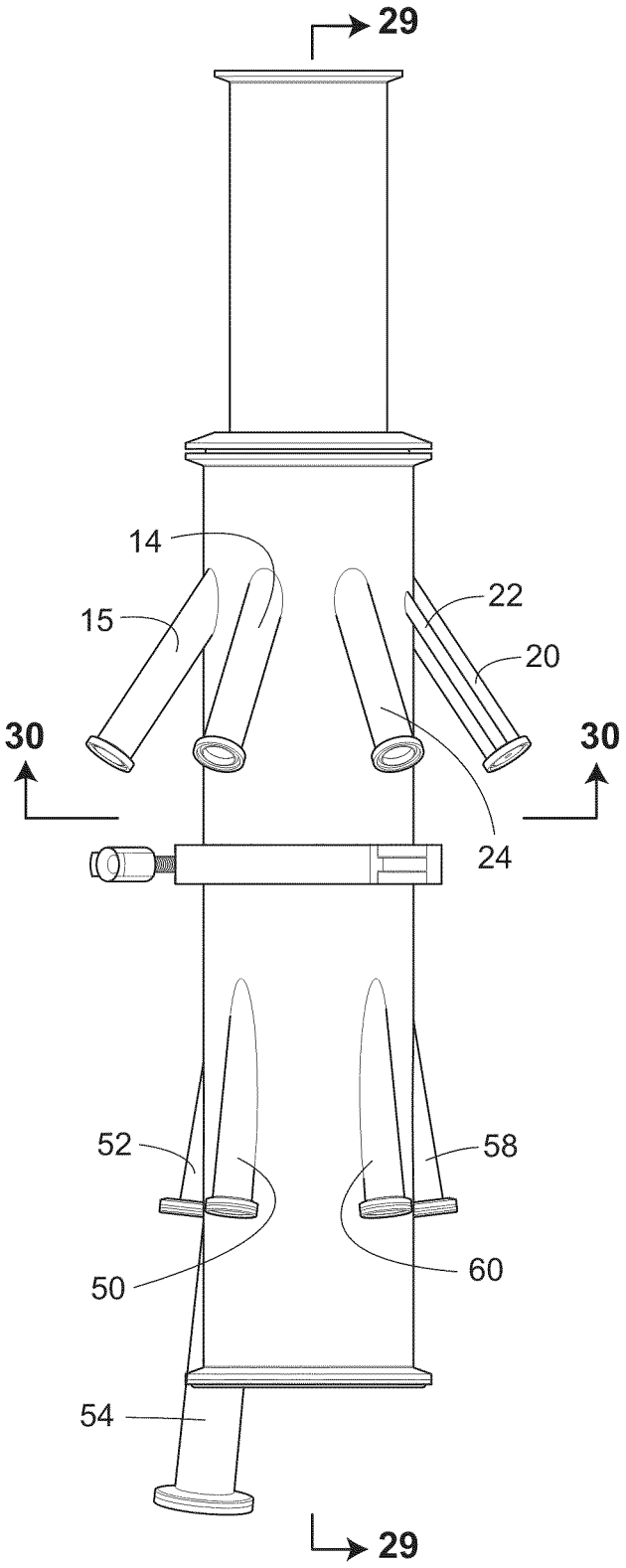
FIG. 28 is a front plan view of a mixing assembly for use in a semi-continuous for the production of liquid personal care compositions including a first plurality of injection tubes intersecting a main feed tube at a first axial distance from an orifice and a second plurality of injection tubes intersecting the main feed tube at a second axial distance from the orifice, the second axial distance being different from the first axial distance, and each of the second plurality of injection tubes intersecting the main feed tube and terminating at a different angle with respect to the axis of the main feed tube than each of the first plurality of injection tubes.
Figure 29:
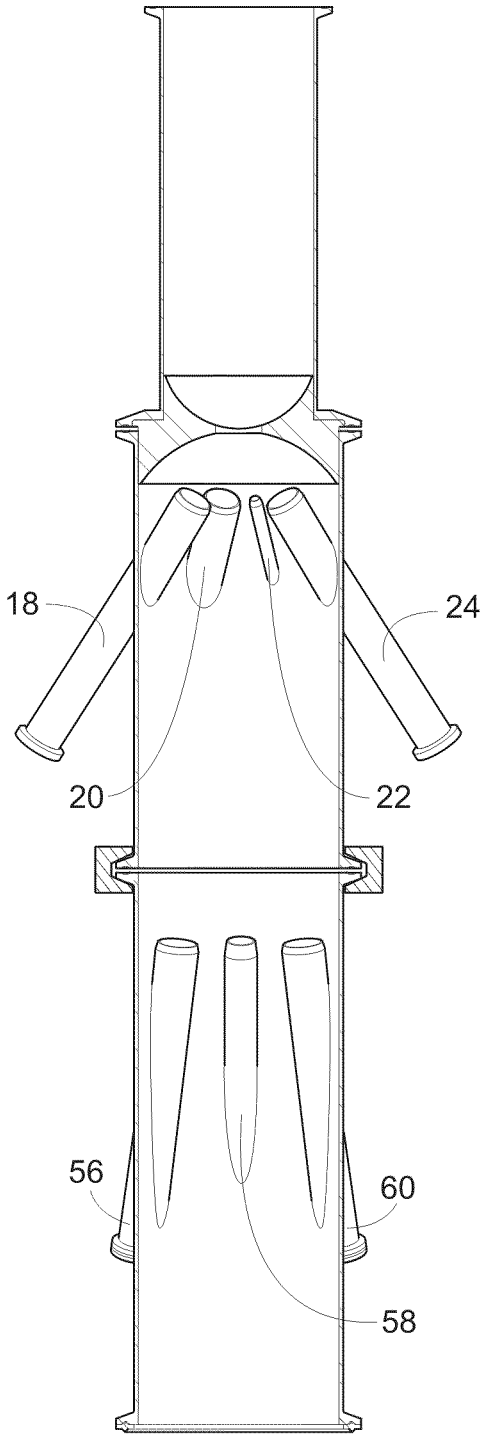
FIG. 29 is a cross-sectional view taken along lines 29-29 of FIG. 28.
Figure 30:
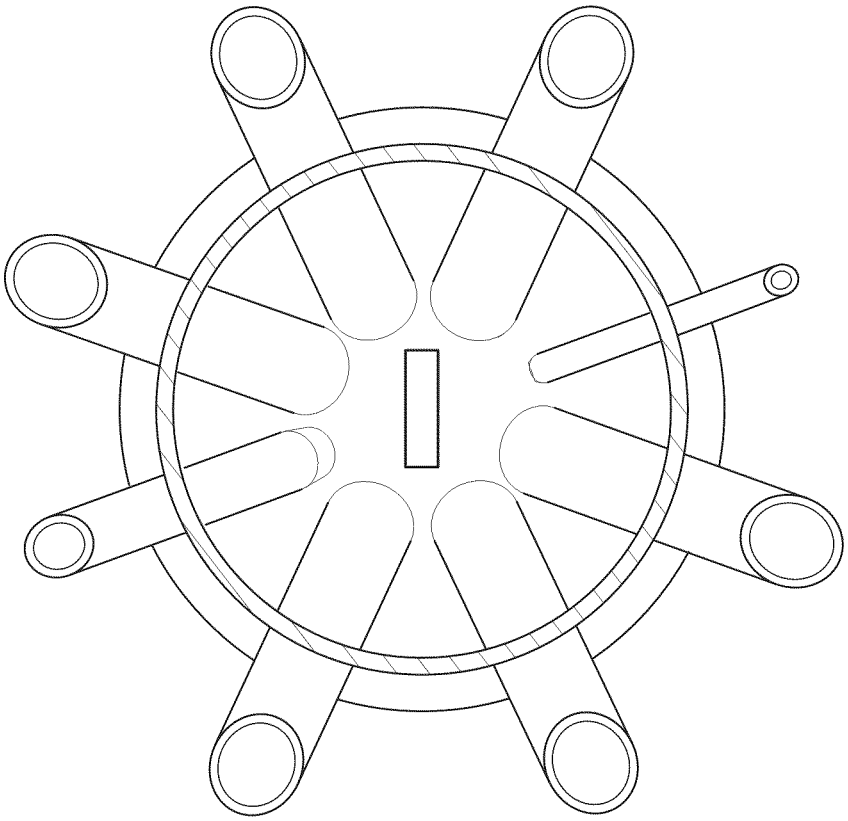
FIG. 30 is a cross-sectional view taken along lines 30-30 of FIG. 28.
Figure 31:
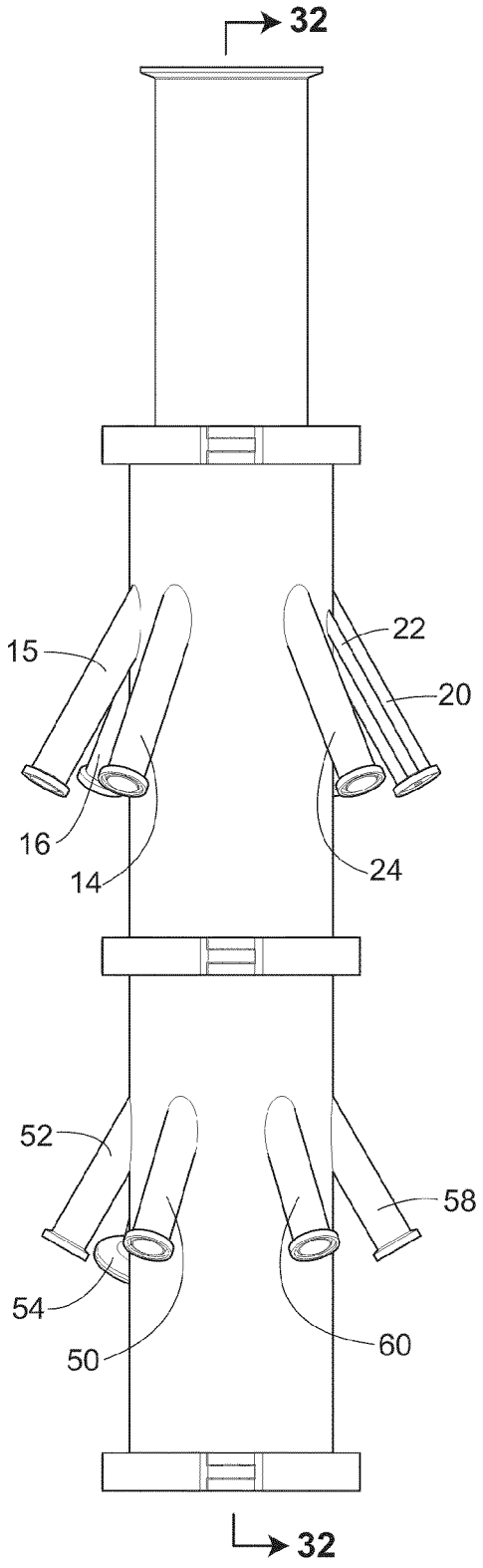
FIG. 31 is a front plan view of a mixing assembly for use in a semi-continuous for the production of liquid personal care compositions including a first plurality of injection tubes intersecting a main feed tube at a first axial distance from an orifice and a second plurality of injection tubes intersecting the main feed tube at a second axial distance from the orifice, the second axial distance being different from the first axial distance, each of the first plurality of injection tubes intersecting the main feed tube and terminating at an angle with respect to the axis of the main feed tube, and each of the second plurality of injection tubes intersecting the main feed tube at a non-zero angle with respect to the axis of the main feed tube, and inwardly of the inner diameter of the main feed tube, bending to a region extending parallel to the axis of the main feed tube.
Figure 32:
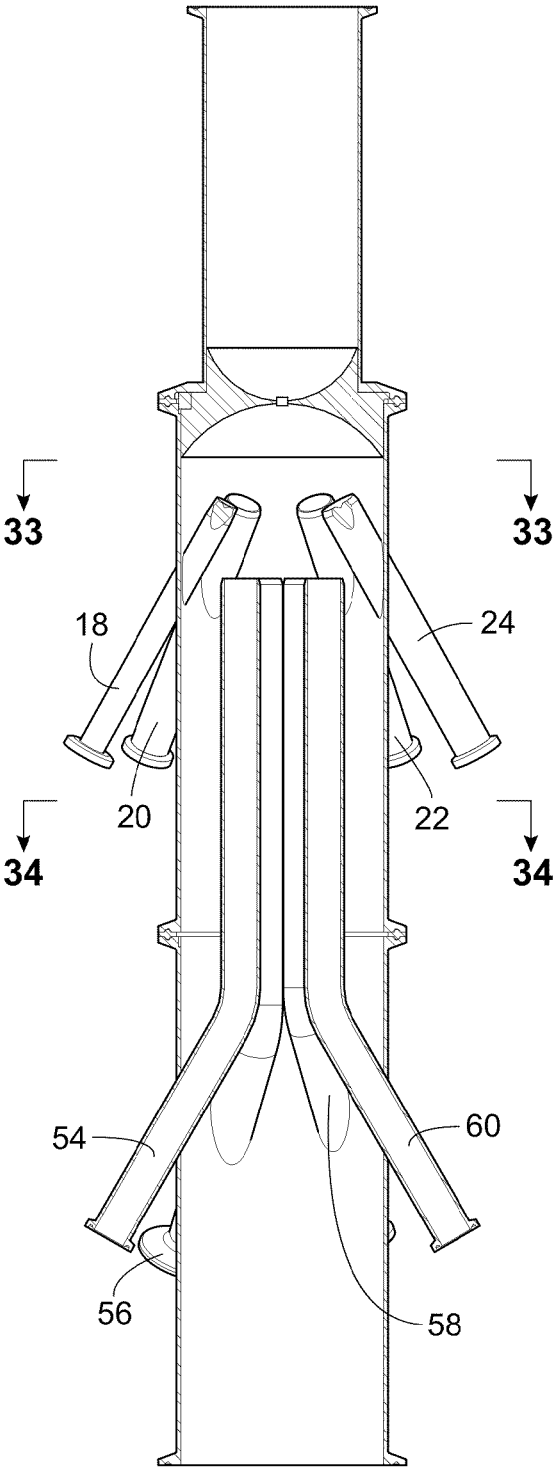
FIG. 32 is a cross-sectional view taken along lines 32-32 of FIG. 31.
Figure 33:
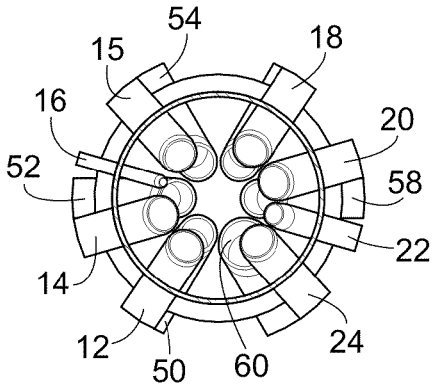
FIG. 33 is a cross-sectional view taken along lines 33-33 of FIG. 31.
Figure 34:
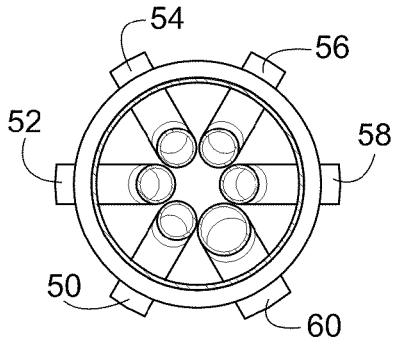
FIG. 34 is a cross-sectional view taken along lines 34-34 of FIG. 31.

In the embodiment illustrated in FIGS. 28-30, like the embodiment illustrated in FIGS. 25-27, the second plurality of injection tubes 50-60 intersect the main feed tube 12 at a different axial location relative to the orifice 30 than the first plurality of injection tubes 14-24. However, the second plurality of injection tubes 50-60 form a significantly smaller non-zero angle with respect to the axis of the main feed tube 12 than the first plurality of injection tubes 14-24. The angle of each given injection tube with respect to the axis of the main feed tube is determined based on such factors as the proximity of the injector outlets to the orifice 30, the diameter of the main feed tube 12, the number of injection tubes intersecting the main feed tube 12, the axial distance from the orifice at which the injection tubes intersect the main feed tube, and the diameter of the injection tubes. In the embodiment illustrated in FIGS. 31-34, like the embodiment illustrated in FIGS. 25-27, the second plurality of injection tubes 50-60 intersect the main feed tube 12 at a different axial location relative to the orifice 30 than the first plurality of injection tubes 14-24, the second plurality of injection tubes intersecting the main feed tube 12 at a greater axial distance from the orifice 30 than the first plurality of injection tubes 14-24. Each of the first plurality of injection tubes 14-24 intersects the main feed tube 12 and terminates at a non-zero angle with respect to the axis of the main feed tube 12. Each of the second plurality of injection tubes 50-60 similarly intersect the main feed tube at a non-zero angle with respect to the axis of the main feed tube 12, but inwardly of the inner diameter of the main feed tube 12, bend to a region extending parallel to the axis of the main feed tube 12, with all of the injector outlets of the second plurality of injection tubes 50-60 being co-planar and spaced a greater axial distance from the orifice 30 than the injector outlets of the first plurality of injection tubes 14-24.

The most stringent blending condition occurs when fluid increases in viscosity or when a fluid is assembled from components that differ in viscosity. Depending on the viscosity-building characteristics of a particular fluid composition(s) to be assembled by a particular mixing assembly, different considerations among design trade-offs will factor into the arrangement of rows of injection tubes that will be optimal for producing those fluid compositions. Generally, a mixing assembly's upstream design is focused on achieving blending with the optimal energy input. Minimizing energy input is desirable to minimize manufacturing costs, and reduce the risks of damaging the fluid compositions being assembled if components thereof are sensitive to shear rate and/or energy level. It is found that design considerations which contribute to managing symmetry at the orifice 30, and minimizing upstream blending (particularly for quick viscosity-building or high viscosity compositions) serve to reduce energy input.

Where there are multiple rows of injection tubes, as in the embodiments illustrated in FIGS. 16-33, various strategies are found to manage symmetry at the orifice or reduce blending upstream of the orifice, depending on the location of the injector outlets of the injection tubes relative to the orifice 30, flow rates of injection tubes, and other variables. These strategies are summarized below:

To manage symmetry at the orifice, variations in the positioning, sizing, and control of fluid velocity at the injector outlets of each of the first plurality of injection tubes 14-24 include (1) directing the fluid from the injection tubes 14-24 to point at the center of the orifice 30 (i.e., toward an intersection of the major and minor axes of the orifice 30 for a non-circular orifice 30); (2) maintaining similar fluid velocities (at least within the same order of magnitude) across all injector outlets of the first plurality of injection tubes 14-24; (3) in the case of a non-circular orifice 30, position lower flow rate injection tubes 16, 22 toward the center of the orifice 30 to help compensate for tendencies of fluid components introduced into the main feed tube 12 at lower flow rates being overpowered by components being introduced at higher flow rates and pushed radially outwardly, away from the orifice 30; and (4) positioning the injector outlets of lower flow rate injection tubes 16, 22 so as to be flush with, or immediately proximate, other injector outlets of the first plurality of injector tubes 14-24.

To further manage symmetry at the orifice, variations in the positioning, sizing, and control of fluid velocity at the injector outlets of each of the second plurality of injection tubes 50-60 include (1) having the injector outlets of the second plurality of injection tubes 50-60 terminate at the inner diameter of the main feed tube 12, as illustrated in FIGS. 18-19, as low angles of portions of injection tubes projecting inwardly of the inner diameter of the main feed tube 12 become difficult to manufacture with two rows of injection tubes intersecting the main feed tube 12, particularly if they intersect the main feed tube 12 at the same axial distance from the orifice 30; (2) as in the case of the first plurality of injection tubes 14-24, maintaining similar fluid velocities (at least within the same order of magnitude) across all injector outlets of the second plurality of injection tubes 50-60; (3) as in the case of the first plurality of injection tubes 14-24, position any lower flow rate injection tubes of the second plurality of injection tubes 50-60 toward the center of a non-circular orifice 30 to help compensate for tendencies of fluid components introduced into the main feed tube 12 at lower flow rates being overpowered by components being introduced at higher flow rates and pushed radially outwardly, away from the orifice 30; and (4) as in the case of the first plurality of injection tubes 14-24, positioning the injector outlets of lower flow rate injection tubes of the second plurality of injection tubes 50-60 so as to be flush with, or immediately proximate, other injector outlets of the second plurality of injector tubes 50-60.

Strategies also exist for minimizing upstream blending, that is, any undesirable blending of components upstream of the orifice 30 in a manner that is likely to cause inconsistent concentration gradients at the orifice inlet and lead to ineffective homogeneous mixing downstream of the orifice, for example introducing variations in concentrations that could cause unacceptable differences in different bottles of fluids packaged from the assembly. For injection tubes in the first plurality of injection tubes 14-24, these strategies include: (1) positioning the injector outlet of each of the plurality of injection tubes 14-24 such that lag is minimized, particularly in systems that build viscosity. (It is desirable to blend components prior to viscosity growth, where possible. It is recognized that depending on the viscosities and viscosity build rates, some fluid compositions are more accepting of lag between injector outlets than others.); (2) minimizing the distance from the injector outlets of each of the first plurality of injection tubes 14-24 to the orifice 30; (3) ensuring a semi-spherical or ellipsoidal shape for the entry surface 28 on the upstream or inlet side of the orifice 30, which is found to maximize energy density across the orifice 30; (4) controlling injector outlet velocities and positioning injector outlets so as to avoid stream collisions; and (5) selecting main tube diameters by balancing fluid volume (minimizing fluid volume to decrease lag time), making adjustments affecting the Reynolds number (adjustments to which vary turbulence upstream and/or downstream of the orifice 30).

In the case of a second row of injection tubes, i.e. those of the second plurality of injection tubes 50-60, while such additional injection tubes make it increasingly difficult to minimize blending upstream of the orifice 30, strategies for minimizing upstream blending include (1) adding low viscosity fluids that tend not to build viscosity in the second plurality of injection tubes 50-60; (2) adding fluids that will help reduce viscosity in the second plurality of injection tubes 50-60; (3) as in the case of the first plurality of injection tubes 14-24, ensuring a semi-spherical or ellipsoidal shape for the entry surface 28 on the upstream or inlet side of the orifice 30; (4) vary the angles of the second plurality of injection tubes 50-60 with respect to the axis of the main feed tube 12 from the angles of the first plurality of injection tubes 50-60 with respect to the axis of the main feed tube 12, as illustrated in the embodiments of FIGS. 28-30 and 31-34; and (5) making adjustments to tube diameter and Reynolds number for the second plurality of injection tubes 50-60.

Other elements, adjustments or considerations that can positively (or negatively) affect blending upstream of the orifice and symmetry at the orifice include the use of static mixers, venturis, elbows or other turns in the pipe, pipe diameter changes, mills, obstructions such as protruding injectors.

A mixing assembly of the present disclosure may be oriented such that the orifice is disposed at a greater height than the injection tubes, as illustrated in FIGS. 17, 19, 20, 24-26, 28-29, and 31-32, with components from the injection tubes aimed upward toward the orifice. In this orientation, it is found that cleanability of the assembly is enhanced. Alternately, the orientation of a mixing assembly of the present disclosure may be such that the orifice is disposed at a lower height than the injection tubes, as illustrated in FIG. 6, with components from the injection tubes aimed downward toward the orifice. Other orientations, such as injection tubes oriented about a horizontally-extending main feed tube, or even about an inclined main feed tube, are possible and considered within the scope of the present disclosure. Certain of these orientations of the mixing assembly may be more preferable than others for use with injection tubes that add materials with particulates which could settle out depending on the orientation of injection tubes containing such materials.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluid mixing assembly comprising:

a main feed tube;

a mixture-carrying tube downstream of the main feed tube;

an orifice provided in a wall separating the main feed tube from the mixture-carrying tube wherein the wall in which the orifice is provided includes a curved entry surface on an upstream side of the orifice, and a curved exit surface on a downstream side of the orifice; and a plurality of injection tubes disposed about the main feed tube and projecting through a side-wall of the main feed tube, each of the injection tubes having an exit in fluid communication with an interior of the main feed tube and being directed toward the orifice, wherein each of the plurality of injection tubes is disposed at an angle of about 30° relative to an axis of the main feed tube, wherein at least one of the injection tubes is of a smaller inner diameter than the other of the injection tubes and wherein the exit of the injection tube having the smaller inner diameter is disposed approximately equidistant to each of a first end and a second end of a major axis of the orifice, the orifice being of a rectangular or an elliptical shape.

2. The fluid mixing assembly of claim 1, wherein the curved entry surface is semispherical.

3. The fluid mixing assembly of claim 1, wherein the curved exit surface is semi-elliptical.

4. The fluid mixing device of claim 1, wherein the orifice is of a channel shape, having a constant width from the entry surface on the upstream side thereof to the exit surface on the downstream side thereof.

5. The fluid mixing assembly of claim 1, wherein each of the plurality of injection tubes is provided with a clamping mechanism for selective securement of the injection tube with a source of material to be introduced into the main feed tube via the injection tube.

6. The fluid mixing assembly of claim 1, wherein the orifice is included in an orifice insert, the orifice insert being removably secured between the main feed tube and the mixture-carrying tube.

7. The fluid mixing assembly of claim 1, further including a second plurality of injection tubes disposed about the main feed tube and having injector outlets that coincide with an inner diameter of the main feed tube and are in fluid communication with the main feed tube.

8. The fluid mixing assembly of claim 7, wherein the second plurality of injection tubes intersect the main feed tube at an axial distance from the orifice equal to an axial distance at which the plurality of injection tubes projecting through the side-wall of the main feed tube intersect the main feed tube.

9. The fluid mixing assembly of claim 1, wherein the plurality of injection tubes includes a first plurality of injection tubes and a second plurality of injection tubes, the second plurality of injection tubes including injector outlets disposed at a different axial distance from the orifice than injector outlets of the first plurality of injection tubes.

10. The fluid mixing assembly of claim 9, wherein each of the injector outlets of the first plurality of injection tubes and of the second plurality of injection tubes form an equal non-zero angle with respect to an axis of the main feed tube.

11. The fluid mixing assembly of claim 9, wherein each of the injector outlets of the first plurality of injection tubes forms a first non-zero angle with respect to an axis of the main feed tube and each of the injector outlets of the second plurality of injection tubes forms a second angle with respect to the axis of the main feed tube, the second angle being different from the first angle.

12. The fluid mixing assembly of claim 9, wherein a region of each of the second plurality of injection tubes radially inwardly of the inner diameter of the main feed tube extends parallel to axis of the main feed tube.

* * * * *